US007963141B2

(12) United States Patent
Nagai et al.

(10) Patent No.: US 7,963,141 B2
(45) Date of Patent: Jun. 21, 2011

(54) PRESS WORKING METHOD AND PRESS WORKING APPARATUS

(75) Inventors: Yuichi Nagai, Tochigi (JP); Hideo Meguri, Tochigi (JP); Kenzo Takeda, Tochigi (JP); Takayuki Egawa, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/833,357

(22) Filed: Jul. 9, 2010

(65) Prior Publication Data

US 2010/0275670 A1 Nov. 4, 2010

Related U.S. Application Data

(62) Division of application No. 11/733,427, filed on Apr. 10, 2007, now Pat. No. 7,765,848.

(30) Foreign Application Priority Data

Apr. 14, 2006 (JP) ..... 2006-112242
Apr. 14, 2006 (JP) ..... 2006-112256

(51) Int. Cl.
*B21D 45/00* (2006.01)
*B21D 43/02* (2006.01)

(52) U.S. Cl. ..... 72/345; 72/417

(58) Field of Classification Search ..... 72/345, 72/347–349, 353.2, 354.2, 295–297, 309, 72/344, 354.6, 354.8, 417, 446
See application file for complete search history.

(56) References Cited

U.S. PATENT DOCUMENTS

| | | | | |
|---|---|---|---|---|
| 3,307,388 | A * | 3/1967 | Brooks, Jr. et al. | 72/348 |
| 4,615,205 | A * | 10/1986 | Ragland, Jr. | 72/347 |
| 4,918,956 | A * | 4/1990 | Schoch | 72/446 |
| 5,941,110 | A | 8/1999 | Cao et al. | |
| 6,032,504 | A * | 3/2000 | Onat et al. | 72/297 |
| 6,530,255 | B1 | 3/2003 | Usui et al. | |
| 2005/0189900 | A1 | 9/2005 | Beyer et al. | |
| 2005/0274243 | A1 | 12/2005 | Shiroza et al. | |
| 2006/0010953 | A1 | 1/2006 | Turner et al. | |

FOREIGN PATENT DOCUMENTS

| | | |
|---|---|---|
| DE | 26 51 488 | 5/1978 |
| DE | 2730432 | 1/1979 |
| DE | 4109796 A1 | 10/1992 |
| DE | 198 42 750 | 4/2000 |
| EP | 1 273 364 | 1/2003 |
| EP | 1 552 893 | 7/2005 |
| JP | 01-266923 | 10/1989 |
| JP | 03-090222 | 4/1991 |

(Continued)

*Primary Examiner* — Teresa M Ekiert
(74) *Attorney, Agent, or Firm* — Rankin, Hill & Clark LLP

(57) ABSTRACT

In a press working apparatus, while a servo motor is acting, an upper die is made to come close to a lower die and press working of the first time is conducted on a steel plate. A slider is raised to a movable punch preparation position. A movable punch is protruded from a die face of the upper die by width and locked by a mechanical lock. The upper die is made to come close to the lower die again and the steel plate is pushed with the upper die and at the same time an additional worked portion is pushed and deformed with the movable punch so as to conduct press working of the second time. After the movable punch has been retracted, the slider is raised.

4 Claims, 20 Drawing Sheets

FOREIGN PATENT DOCUMENTS

| | | |
|---|---|---|
| JP | 3537287 | 10/1998 |
| JP | 2001-150200 | 6/2001 |
| JP | 2005-199318 | 7/2005 |
| WO | 2005/016571 | 2/2005 |

* cited by examiner

DISPLACEMENT OF SLIDER

DISPLACEMENT OF BLANK HOLDER

DISPLACEMENT OF MOVABLE PRESS

PRESS WORKING METHOD AND PRESS WORKING APPARATUS

This application claims foreign priority from Japanese Patent Application Nos. 2006-112242 filed on Apr. 14, 2006, and 2006-112256 filed on Apr. 14, 2006, the entire contents of which are hereby incorporated by reference. This application is a divisional of U.S. Ser. No. 11/733,427, filed on Apr. 10, 2007, which is now issued as U.S. Pat. No. 7,765,848.

BACKGROUND OF THE INVENTION

1. Field of the Invention

The present invention is related to a press working method and a press working apparatus in which a press-formed product is worked by a servo press.

2. Related Art

In a conventional mechanical press, press working is conducted when a slider, which is connected to a crank shaft, is driven upward and downward by a crank shaft rotating motor. In this type mechanical press, since a die is continuously moved upward and downward, it is difficult to change a speed of the die according to a working condition. Further, it is also difficult to temporarily stop the die.

Due to the above circumstances, a servo press has been recently used which can flexibly control a motion of a die with a servo motor. Concerning this matter, refer to JP-A-2001-150200 and JP-B2-3537287. In this type servo press, it is possible to stop the die at a predetermined position in the middle of one stroke in which the die is moved upward and downward.

In this connection, in the case of making a press-formed product, sometimes, a plurality of press forming steps are conducted according to a shape of the product. For example, the following are described in JP-B2-3537287. When a workpiece is worked with a press forming machine described in JP-B2-3537287, it is necessary to conduct multiple steps of press forming. Alternatively, in some cases, a compound working step, in which press working and another working are alternately, repeatedly conducted, is carried out.

However, according to JP-B2-3537287, multiple steps of the stopping positions of the upper die are set with respect to a workpiece which requires multiple steps (multiple motions). With respect to the other working which can not be executed only by the upper die, it is necessary to provide another independent working means, which can be a factor to increase the working time and working cost.

Especially, in the case of a plate for which a plurality of times of press forming are required, it is actually necessary to provide press forming apparatus, the number of which is the same as the number of press forming steps. Therefore, a space for installing the press forming apparatus is increased. Further, it takes labor to convey a plate between the apparatus.

Further, in press working, when the working is conducted while a periphery of a portion to be pressed is being pinched by a predetermined holder, it is possible to prevent the generation of wrinkles. In JP-A-2005-199318, a method is described in which working is conducted while a steel plate is being held by a holder.

In this connection, when the plate is held by the holder at the time of press working, depending upon a shape of a product to be formed, an excessively high tension is given to the plate concerned. Accordingly, more wrinkles are generated. Further, excessively small wall thickness portions may be generated on the product to be formed.

According to the method described in JP-A-2005-199318, the steel plate is lightly pushed by a blank corresponding to the holder. Therefore, at the time of working, the steel plate is drawn inside a die, that is, the steel plate is not continuously pushed by the blank at all times. Accordingly, it is possible to somewhat prevent wrinkles from being generated. It is also possible to somewhat prevent small wall thickness portions from being generated.

However, the method described in JP-A-2005-199318 is so-called deep drawing. Therefore, it is impossible to effectively apply the method described in Patent Document 3 to forming of mass-produced products.

The method described in JP-A-2005-199318 is applied on the assumption that almost all the steel plate is drawn inside the die being slid on the die at the time of working. Therefore, it is necessary that a pushing force given by the blank is finely adjusted according to the shape of the formed product and the material and the surface roughness of the steel plate. Further, an operator must be sufficiently experienced in selecting appropriate lubricant for press forming.

SUMMARY OF THE INVENTION

One or more embodiments of the present invention provide a press working method and a press working apparatus capable of effectively conducting press working on a plate a plurality of times in a short period of working time.

In accordance with one or more embodiments of the present invention, a press working method of working a press-formed product with a servo press, is provided with: a press forming step of conducting press forming on a plate when a first die is made to come close to a second die; a punch protruding step in which the first die is separated from the second die and a movable punch is protruded from the first die toward the second die and locked; and an additional forming step in which the first die is again made to come close to the second die after the completion of the punch protruding step and the plate, which has already been pressed, is pressed by the first die and a portion of the plate is pushed and deformed by the movable punch.

As described above, after the completion of press forming, the first die is separated from the second die and then the movable punch is protruded and locked and further the first die is again made to come close to the second die. Due to the foregoing, without using another independent working means, a press forming step, which is an additional working step, can be conducted again on the plate on which the press forming of the first time has already been completed.

In this case, when the operation time of control in the punch protruding step and the additional forming step after the completion of press forming is set by a controller for conducting control so that the first die can be made to come close to the second die, accurate synchronization can be made.

When a position at which the first die is separated in the punch protruding step is set at a position located closer to a bottom dead center than a top dead center of the first die, it is unnecessary that the upper die is returned to the top dead center and the cycle time can be reduced.

In addition, in accordance with one or more embodiments of the present invention, a press working apparatus in which servo press control is conducted, is provided with: a movable punch provided in a first die and capable of protruding from a press forming face; and a lock means for locking the movable punch at a position protruding from the press forming face, wherein after the first die has been made to come close to the second die and a plate has been pressed, the first die is separated from the second die and themovable punch is protruded from the first die toward the second die and locked by the lock means, the first die is again made to come close to the second die so as to push the plate, which has already been subjected to press forming, with the first die and push and deform a portion of the plate with the movable punch.

As described above, after the completion of press forming, the first die is separated from the second die and then the movable punch is protruded and locked and further the first die is again made to come close to the second die. Due to the foregoing, without using another independent working means, a press forming step, which is an additional working step, can be conducted again on the plate on which the first time press forming has already been completed.

When the time of protruding the punch and the time of making the first die come close to the second die are set by the same controller, accurate synchronization can be made.

According to the press working method and the press working apparatus of one or more embodiments of the present invention, after the completion of press forming, the first die is separated from the second die and then the movable punch is protruded and locked and further the first die is again made to come close to the second die. Due to the foregoing, without using another independent working means, a press forming step can be conducted again on the plate on which the first time press forming has already been completed.

Since the movable punch is provided in the first die, the entire apparatus can be made compact. Therefore, a space for installing the apparatus can be made small. Further, only when the movable punch is protruded from the first die and locked, press forming of the second time can be prepared. Therefore, a plurality of press forming steps can be effectively conducted on a plate in a short period of time.

Since press working can be conducted twice by one press working apparatus, it is unnecessary to convey a plate between the apparatus.

Moreover, one or more embodiments of the present invention provide a press forming method and a press forming apparatus, which can be suitably applied to working of a steel plate except for deep drawing, in which it is possible to prevent wrinkles from being generated and further it is possible to prevent small wall thickness portions from being generated.

In accordance with one or more embodiments of the present invention, a press working method of working a press-formed product with a servo press, is provided with: a press forming step in which a plate is pressed when a first die is made to come close to a second die while the plate is being pinched by a first and a second holder; and a pinch release means for releasing a pinch conducted by the first and the second holder on the plate after press forming of the plate was started in the press forming step and before both the dies reach a bottom dead center at which the dies are made to come close to each other.

As described above, when a pinch made by the first and the second holder is released before the first and the second holder reach the bottom dead center at which both the dies are made to come close to each other, the plate can be moved. Accordingly, it is possible to prevent wrinkles, which are generated when the plate is excessively strongly stretched, from being generated. Further, it is possible to prevent small wall thickness portions, which are generated when the plate is excessively strongly stretched, from being generated. In this case, the paragraph "before the first and the second holder reach the bottom dead center" includes the meaning that the first and the second holder have reached the bottom dead center.

In this case, the control operation time in the pinch release step is set by a controller for controlling the first die so that the first die can be made to come close to the second die.

In addition, in accordance with one or more embodiments of the present invention, a press working apparatus in which servo press control is conducted, is provided with: a first and a second die for conducting press forming on a plate; a first holder provided in the first die; a second holder, which is provided at a position opposed to the first holder, for pinching the plate together with the first holder; and a controller for advancing and retracting the second holder, wherein at the time of press forming step in which the plate is pressed when the first die is made to come close to the second die, while the plate is being pinched by the first and the second holder, after press forming of the plate was started and before the first and the second holder reach a bottom dead center at which both the dies are made to come close to each other, the controller releases the plate which are pinched by the first and the second holder.

As described above, when a pinch made by the first and the second holder is released before both the dies reach the bottom dead center at which both the dies are made to come close to each other, it is possible to prevent wrinkles, which are generated when the plate is excessively strongly stretched, from being generated. Further, it is possible to prevent small wall thickness portions, which are generated when the plate is excessively strongly stretched, from being generated. In this case, the paragraph "before the first and the second holder reach the bottom dead center" includes the meaning that the first and the second holder have reached the bottom dead center.

In this case, when the controller conducts controlling so that the first die can be made to come close to the second die, a pinch of the plate can be released accurately synchronously with the press forming.

According to the press working method and the press working apparatus of one or more embodiments of the present invention, when a pinch made by the first and the second holder is released before the first and the second holder reach the bottom dead center at which both the dies are made to come close to each other, the plate can be moved. Accordingly, it is possible to prevent wrinkles, which are generated when the plate is excessively strongly stretched, from being generated. Further, it is possible to prevent small wall thickness portions, which are generated when the plate is excessively strongly stretched, from being generated.

At least at the time of starting press forming, the plate is positively pinched between the first and the second holder. Therefore, positioning can be accurately made and it is possible to prevent wrinkles from being generated at the initial stage of working. Further, operation of pinching and releasing the plate by the first and the second holder can be sufficiently conducted by ON-OFF control and it is unnecessary to give consideration to a slide of the plate. Accordingly, it is not needed to adjust a pushing force. Further, lubricant is not particularly needed. Therefore, operation can be performed simply. The method and apparatus of the present invention can be suitably applied to press working except for deep drawing.

Other aspects and advantages of the invention will be apparent from the following description and the appended claims.

DETAILED DESCRIPTION OF THE EXEMPLARY EMBODIMENTS

First Exemplary Embodiment

A press working method and the press working apparatus of a first exemplary embodiment of the present invention will be explained, referring to FIGS. 1 to 13C. In the press working apparatus 10 of the first exemplary embodiment, after press working of the first time has been conducted on a steel plate (plate member) 12 which is a workpiece, press working of the second time, which is an additional working, is conducted.

Figure 1:
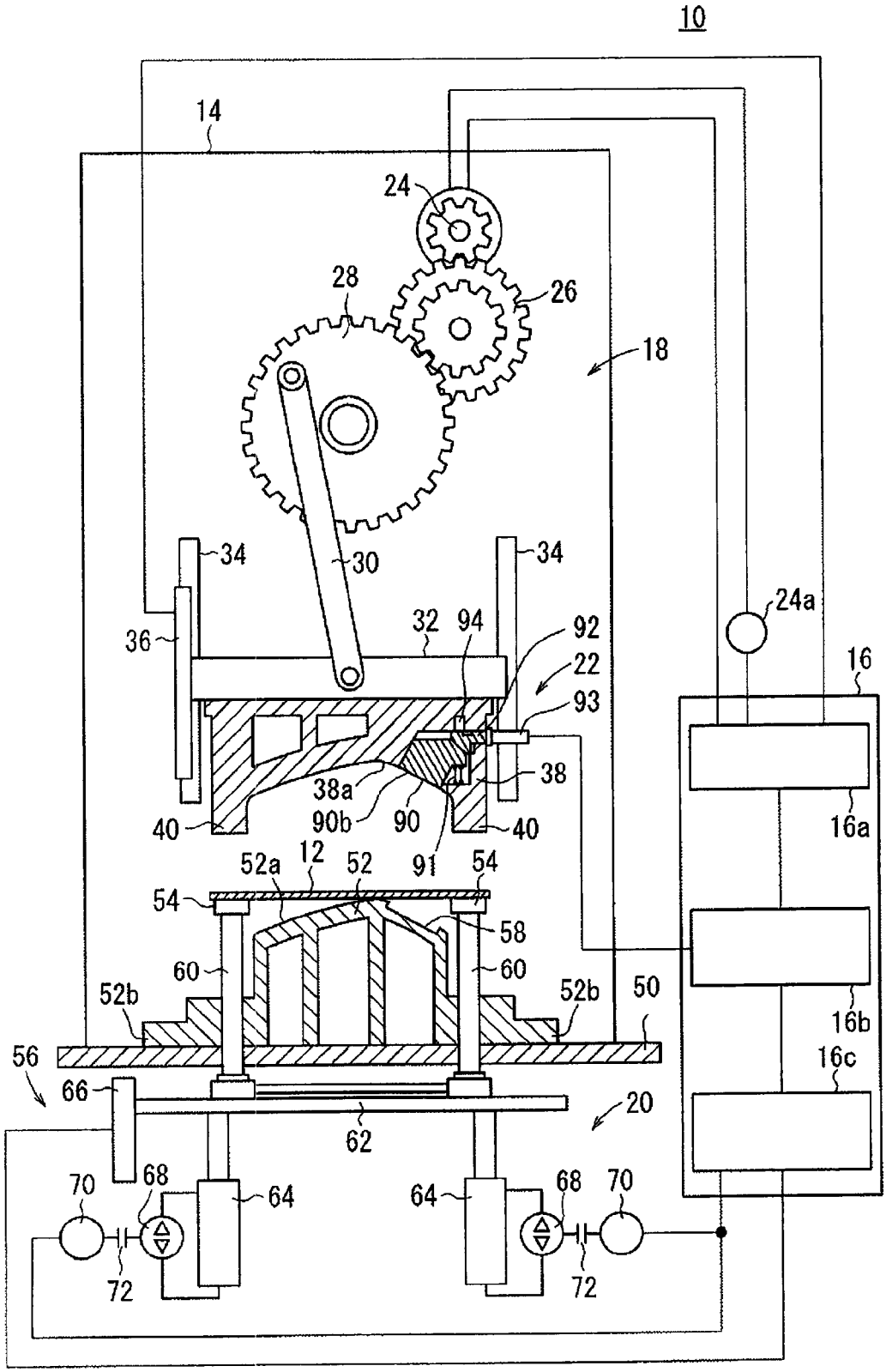
FIG. 1 is a schematic illustration showing an arrangement of the press working apparatus of a first exemplary embodiment.

As shown in FIG. 1, the press working apparatus 10 includes: an apparatus body 14 for conducting working; and a control portion 16 for controlling the apparatus body 14.

The apparatus body 14 includes: an upper die mechanism 18; a lower die mechanism 20; and an additional working portion 22 provided inside the upper die mechanism 18. The upper die mechanism 18 includes: a servo motor 24 which is a drive source; a reduction gear 26 driven and rotated by the servo motor 24; a rotary plate 28 driven and rotated by the reduction gear 26 at high torque; and a connecting rod 30, the upper end portion of which is pivotally attached onto a side of the rotary plate 28 so that the connecting rod 30 can be oscillated. The servo motor 24 is, for example, of the AC type. Therefore, the responding property of the servo motor 24 is high and torque generated by the servo motor 24 seldom deviates. A rotary position of the shaft of the servo motor 24 is detected by an encoder 24*a* and sent to the control portion 16.

The upper die mechanism 18 includes: a slider 32 pivotally supported by an end portion of the connecting rod 30; a plurality of rails 34 (for example, four rails 34) to guide the slider 32 in the vertical direction; a first linear sensor 36 to detect a position of the slider 32 and sent it to the control portion 16; and an upper die (a first die) 38 provided on a lower face of the slider 32.

The upper die 38 pinches a steel plate 12 together with a lower die (a second die) 52 so as to conduct press working. On a lower face of the upper die 38, a die face 38*a* is provided which comes into contact with an upper face of the steel plate 12. From the periphery of the upper die 38, an annular holder 40 is provided being a little protruded which is used for preventing the generation of wrinkles on the steel plate 12 and for preventing the occurrence of a positional deviation of the steel plate 12 at the time of press forming. Accordingly, the holder 40 comes into contact with the steel plate 12 before the die face 38*a*. A lower face of the holder 40 is formed into a shape corresponding to the forming shape, for example, the lower face of the holder 40 is formed into a horizontal face.

Further, the upper die 38 includes an additional working portion 22. The additional working portion 22 is provided for the following reasons. After the press working of the first time has been conducted on the steel plate by the upper die mechanism 18 and the lower die mechanism 20, the additional working portion 22 conducts the press working of the second time so as to conduct an additional working on the steel plate.

Figure 2:
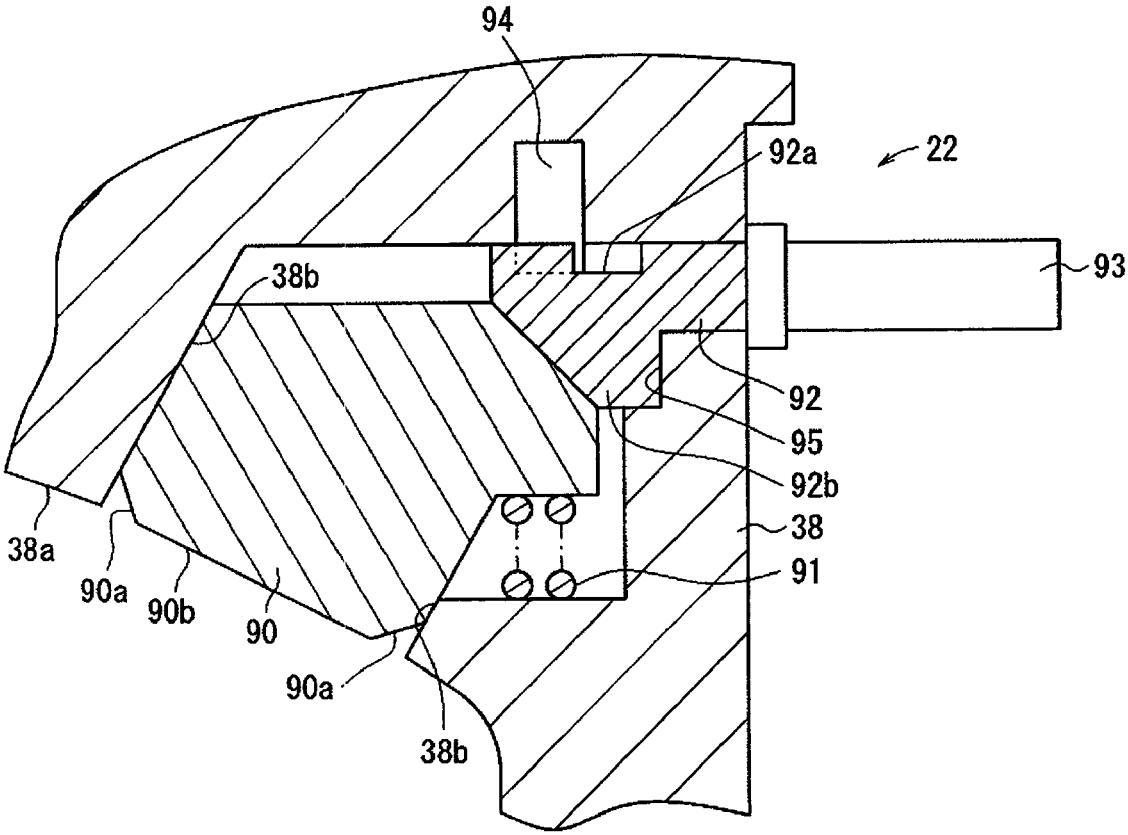
FIG. 2 is an enlarged view showing an additional working machine in a state in which a movable punch is retracted.

As shown in FIG. 2, the additional working portion 22 includes: a movable punch 90 capable of protruding from the die face 38*a*; a spring 91 for pushing the movable punch 90 so that the movable punch 90 can be retracted from the die face 38*a*; a driver rod 92 for protruding the movable punch 90 from the die face 38*a* when the driver rod 92 slides on an inclined face of the movable punch 90; an actuator 93 for pushing out the driver rod 92; and a mechanical lock 94 for locking the driver rod 92 when the mechanical lock 94 is engaged in a cutout portion 92*a* formed on the driver rod 92 which has been pushed out. The mechanical lock 94 is advanced and retracted in a direction perpendicular to the advancing and retracting direction of the driver rod 92 (the lateral direction in FIG. 2) when a predetermined actuator (not shown), which pushes out the mechanical rod 94, is operated. Therefore, the mechanical lock 94 can be attached in and detached from the cutout portion 92*a* An example of the actuator 93 is a cylinder.

The movable punch 90 is engaged in a guide hole 38*b* provided in the upper die 38. For example, the movable punch 90 can be advanced and retracted in an oblique direction as shown in FIG. 2, the inclination angle of which is approximately 45°. In the periphery of the forward end portion of the movable punch 90, a chamfered portion 90*a* is provided.

When the mechanical lock 94 has been released and the driver rod 92 is not pushed by the actuator 93, the movable punch 90 is given a force by an elastic action of the spring 91 so that the movable punch 90 can be retracted into the guide hole 38*b*. Accordingly, the driver rod 92 is moved to the right in FIG. 2. The driver rod 92 is moved until a protruding portion 92*b* of the driver rod 92 comes into contact with a step portion 95 of the upper die 38. At this time, a forward end face 90*b* of the movable punch 90 is set on the same face as the die face 38*a*. In the case where the die face 38*a* is a curved face, the forward end face 90*b* of the movable punch 90 is formed into the same curved face.

Figure 3:
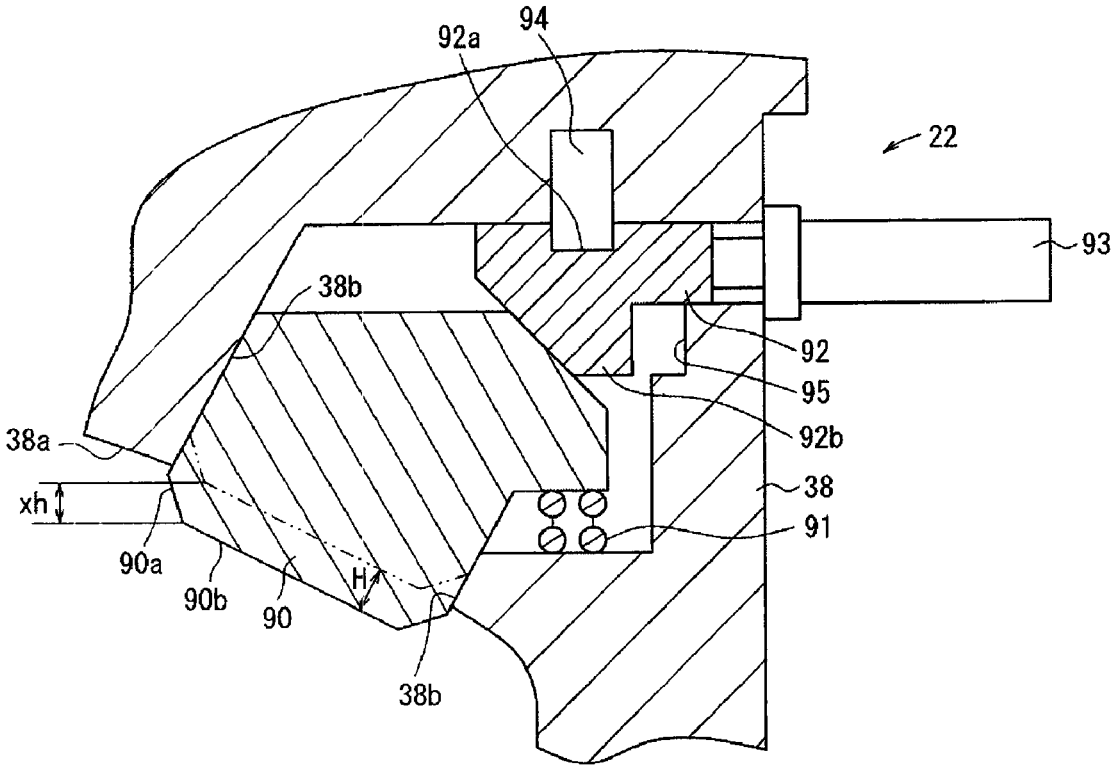
FIG. 3 is an enlarged view showing an additional working machine in a state in which a movable punch is protruded.

As shown in FIG. 3, when the driver rod 92 is pushed by the actuator 93 and moved to the left in FIG. 3, the movable punch 90 proceeds resisting an elastic force of the spring 91. Therefore, a forward end face 90*b* of the movable punch 90 protrudes from the die face 38*a* by width H. At this time, the mechanical lock 94 is engaged in the cutout portion 92*a* and locks the driver rod 92, so that the movable punch 90 can be fixed. An object to be locked by the lock means such as a mechanical lock 94 is not necessarily limited to the driver rod 92 but the movable punch 90 may be locked. In this case, an amount of the downward protrusion of the movable punch 90 from the die face 38*a* is represented by xh. When an inclination angle of the guide hole 38*b* is 45°, xh is represented by the expression $xh=H/2^{1/2}$.

Referring again to FIG. 1, the lower die mechanism 20 includes: a fixation table 50 which is used as a base; a lower die 52 arranged in an upper portion of the fixation table 50; an annular blank holder 54 for supporting a periphery of the steel plate 12; and a die cushion mechanism 56 for elevating a blank holder 54. The blank holder 54 is arranged being opposed to the holder 40. Therefore, the blank holder 54 pinches an end portion of the steel plate 12 together with the holder 40.

The lower die 52 is used for press working when it pinches the steel plate 12 together with the upper die 38. On an upper face of the lower die 52, a die face 52*a* is provided which comes into contact with a lower face of the steel plate 12. This die face 52*a* is formed into a shape corresponding to the aforementioned die face (the press forming face) 38*a*. In the lower face 52, a recess portion 58 is provided at a position corresponding to the additional worked portion 12*a* (shown in FIG. 7) which conducts an additional working on the steel plate 12 after the completion of the press working of the first time. An area of this recess portion 58 is set so that the movable punch 90 can push the steel plate 12 into the recess portion 58 and conduct press forming. A depth of the recess portion 58 is set at a value so that the steel plate 12 can be pinched by the front end face 90*b* and the bottom face 58*a* of the recess portion 58 when the movable punch 90 is inserted into the recess portion 58.

The die cushion mechanism 56 includes: a plurality of pins 60 which penetrate the fixation table 50 and the attaching portion 52*b* of the lower die 52 from the lower side and are fixed in a lower portion of the blank holder 54; a plate 62 for connecting lower end portions of these pins 60; a plurality of cylinders 64 for elevating the plate 62; and a second linear sensor 66 for detecting a position of the plate 62 and sending a signal of the position of the plate 62 to the control portion 16.

The die cushion mechanism 56 includes: a hydraulic motor 68 for supplying hydraulic fluid to the cylinders 64 and for recovering hydraulic fluid from the cylinders 64; and a servo motor 70 for rotating the hydraulic motor 68. Rotation of the servo motor 70 is transmitted to the hydraulic motor 68 through a transmission portion 72 including a coupling, a reduction gear and so forth. The hydraulic motor 68 is rotated either normally or reversely being driven by the servo motor 70. Therefore, it is possible for the hydraulic motor 68 to selectively supply hydraulic fluid to the rod side or the cap side of the cylinder 64. Due to the above constitution, while predetermined pressure control is being conducted, the periphery of the steel plate 12 is appropriately pushed by both the holder 40 and the blank holder 54. Therefore, the generation of wrinkles can be prevented.

The control portion 16 includes: a press drive portion 16*a* for driving and controlling the servo motor 24 while referring to signals sent from the encoder 24*a* and the first linear sensor 36; an additional working machine drive portion 16*b* for driving and controlling the actuator 93 and the mechanical lock 94; and a die cushion drive portion 16*c* for elevating the blank holder 54 by driving the servo motor 70 while referring to a signal sent from the second linear sensor 66. The press drive portion 16*a*, the additional working machine drive portion 16*b* and the die cushion drive portion 16*c* are connected with each other. Therefore, the press drive portion 16*a*, the additional working machine drive portion 16*b* and the die cushion drive portion 16*c* can be operated synchronously with each other.

Figure 4:
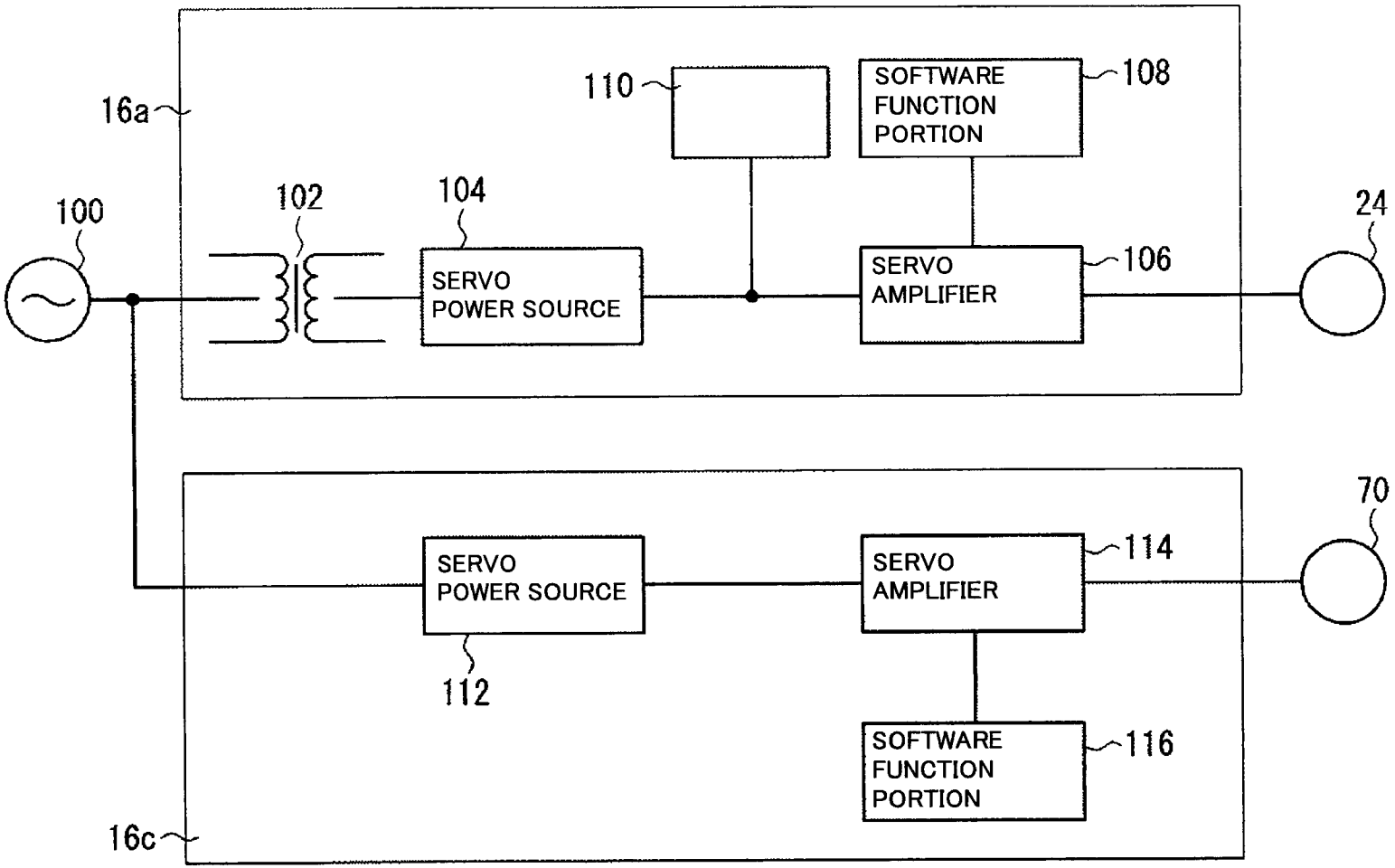
FIG. 4 is a block arrangement diagram showing a press drive portion and a die cushion drive portion.

As shown in FIG. 4, the press drive portion 16*a* includes: a servo power source portion 104 to which electric power obtained from an electric power source 100 is supplied after the voltage has been raised by a transformer 102; and a servo amplifier 106 for driving the servo motor 24 with electric power adjusted by the servo power source portion 104. In the servo amplifier 106, an amount of driving of the servo amplifier 106 is set while the software functional portion 108 is acting. A large capacity condenser 110 is provided between the servo power source portion 104 and the servo amplifier 106.

The die cushion drive portion 16*c* includes: a servo power source portion 112 to which electric power is supplied from the power source 100; and a servo amplifier 114 for driving the servo motor 70 with electric power adjusted by the servo power source portion 112. An amount of driving of the servo motor 70 is set by the servo amplifier 114 while the software functional portion 116 is acting.

An electric current can be made to flow in both the positive and the negative direction in the servo power source portion 112 and the servo amplifier 114. In the case where the servo motor 70 is rotated by a load and generates electricity, it is possible to conduct a regeneration of electric power in which an electric current obtained by the generation of electric power is supplied to the press drive portion 16*a*. The thus regenerated electric power is stored in the large capacity condenser 110 and used for driving the servo motor 24. Therefore, an increase in the power source capacity can be suppressed.

Figure 5:
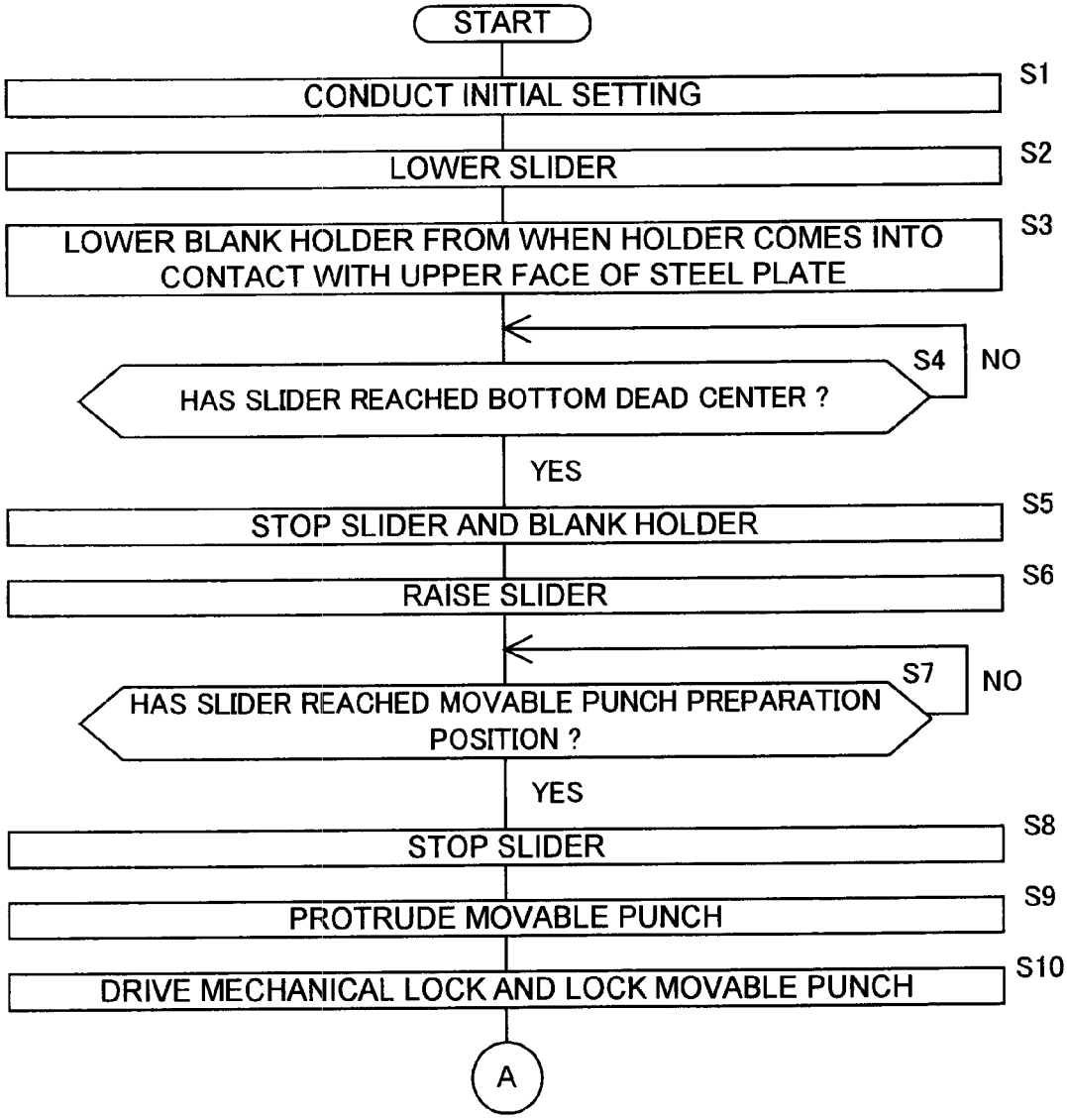
FIG. 5 is a flow chart (1) showing a procedure of the press working method of the first exemplary embodiment.
Figure 6:
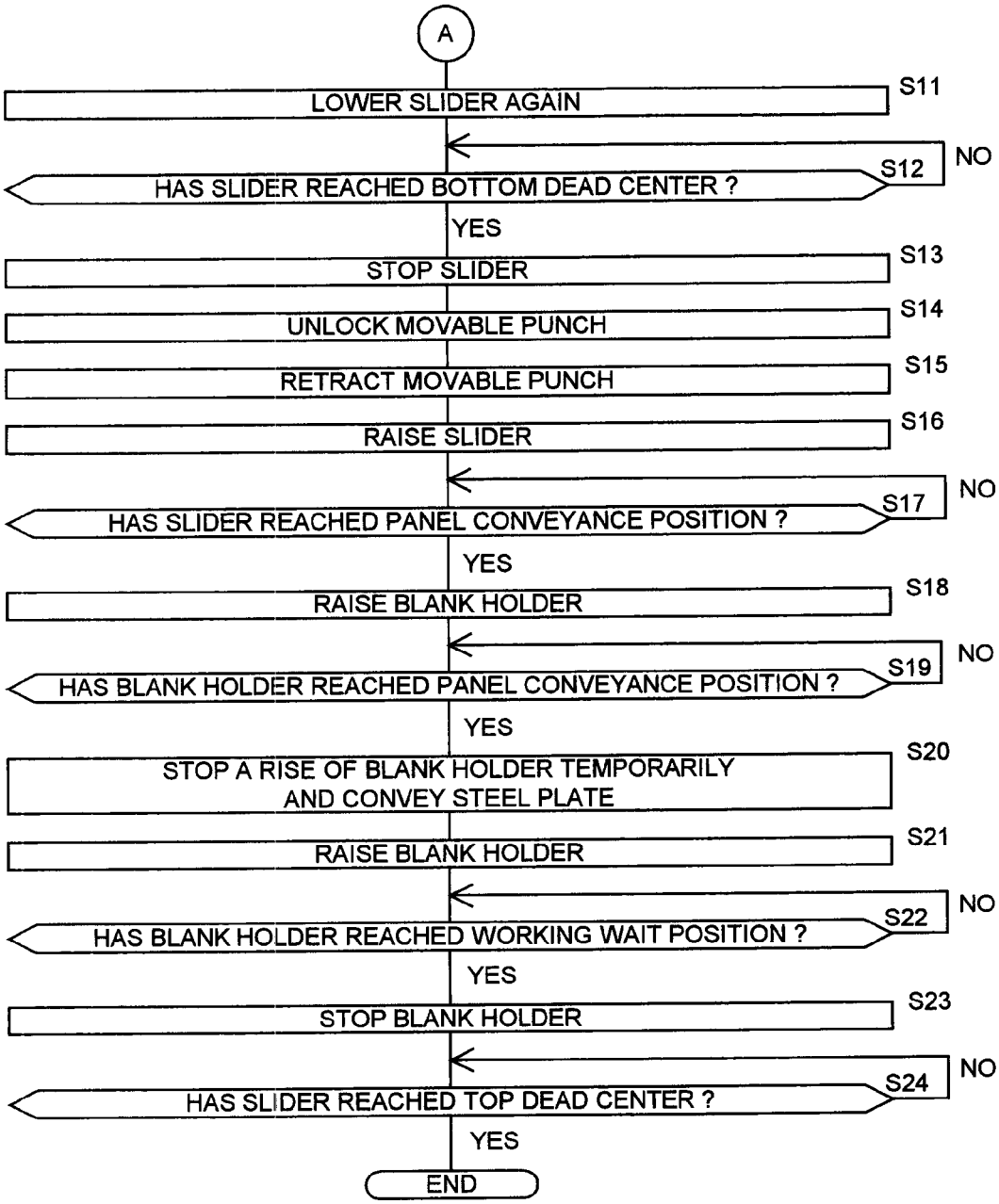
FIG. 6 is a flow chart (2) showing a procedure of the press working method of the first exemplary embodiment.

Referring to FIGS. 5 and 6, explanations will be made into a working method of working the steel plate 12, which is a workpiece, with the press working apparatus 10 composed as described above.

First of all, initial setting is made in step S1 in FIG. 5. That is, after the blank holder 54 has been raised to a predetermined position, the steel plate 12, which has not been worked yet, is supported by the blank holder 54. In the additional working portion 22, the actuator 93 is retracted and the upper die 38 is raised to an upper dead center.

In step S2, while the press drive portion 16*a* is acting, the servo motor 24 is driven and rotated so as to lower the slider 32.

When the slider 32 is somewhat lowered, the holder 40 comes into contact with an upper face of the steel plate 12. Therefore, the steel plate 12 is interposed between the holder 40 and the blank holder 54. At this point of time (shown by displacement x3 in FIG. 13A), the blank holder 54 is lowered while the die cushion drive portion 16*c* is acting (step S3). The die cushion drive portion 16*c* conducts pressure control so that the blank holder 54 can be lowered while the steel plate 12 is positively being held by an appropriate force generated by the blank holder 54 when a lower face of the steel plate 12 is pushed by the blank holder 54. That is, the blank holder 54 is pushed by the holder 40 via the steel plate 12. Therefore, the blank holder 54 is lowered while the steel plate 12 is being given an appropriate force.

Due to the foregoing, while the peripheral portion of the steel plate 12 is being held by the holder 40 and the blank holder 54, the steel plate 12 is gradually pressed to a product shape by the upper die 38 and the lower die 52.

In the case of lowering the blank holder 54, the aforementioned regeneration may be made when electric power is generated by the servo motor 70.

In step S4, according to a signal sent from the first linear sensor 36, the press drive portion 16*a* confirms whether or not a position of the slider 32 has reached the bottom dead center (that is, the lowest position during one stroke of the upper die 38). When the slider 32 has reached the bottom dead center, the program proceeds to step S5. When the slider 32 has not reached the bottom dead center, the slider 32 continues to be lowered.

Figure 7:
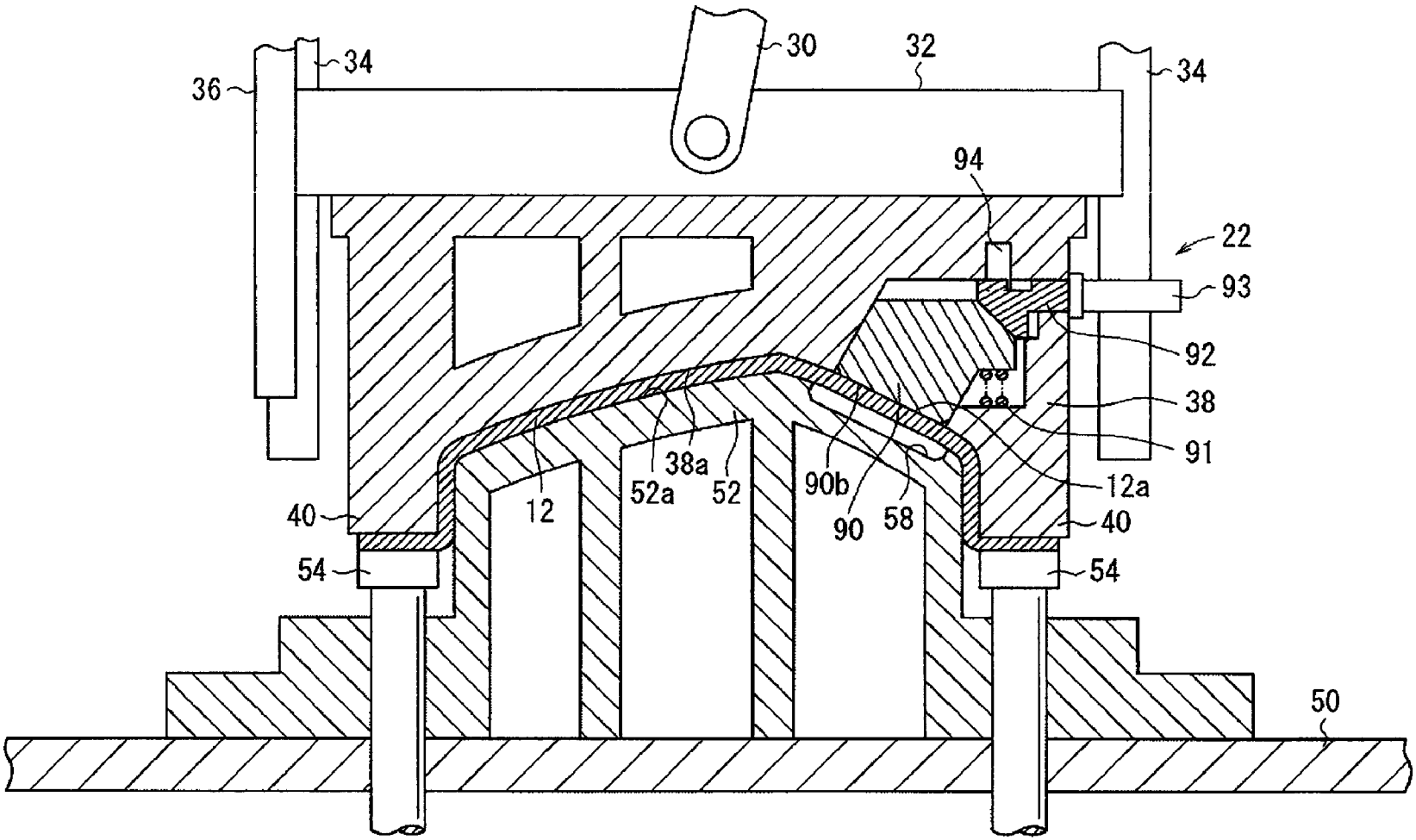
FIG. 7 is a partially sectional enlarged view showing an upper die, a lower die, an additional worked portion of a steel plate and an additional working portion in the case where a slider is stopped at a bottom dead center.

In step S5, operation of lowering the slider 32 and the blank holder 54 is temporarily stopped. At this time, as shown in FIG. 7, the steel plate 12 is pinched between the die face 38*a* of the upper die 38 and the die face 52*a* of the lower die 52 and press working has already been completed.

In step S6, while the press drive portion 16*a* is acting, the servo motor 24 is driven and rotated so as to raise the slider 32.

In step S7, it is confirmed whether or not the slider 32 has been raised to a predetermined position at which the movable punch is ready for punching operation. When the slider 32 has been raised to the predetermined position at which the movable punch is ready for punching operation, the program proceeds to step S8. When the slider 32 has not been raised to the predetermined position at which the movable punch is ready for punching operation, the slider 32 continues to be raised.

In step S8, while the press drive portion 16*a* is acting, the servo motor 24 is stopped so as to stop the slider 32 at the movable punch preparation position. The movable punch preparation position may be any position as long as the movable punch 90 can be protruded at the position. The movable punch preparation position is a position sufficiently lower than displacement x3 at the point of time when the holder 40 comes into contact with an upper face of the steel plate 12 in step S3 described before. Concerning this matter, refer to FIG. 13A.

To be specific, it is preferable that distance xp from the bottom dead center to the movable punch preparation position is approximately 1 to 5 times as long as an amount of the downward protrusion xh (shown in FIG. 3) of the movable punch 90. It is more preferable that distance xp from the bottom dead center to the movable punch preparation position is approximately 1.1 to 3 times as long as the amount of the downward protrusion xh. When distance xp is set as described above, the movable punch 90 can be positively protruded. Further, a period of time necessary for raising the slider 32 can be reduced. Accordingly, the cycle time can be shortened.

In step S9 (the punch protruding step), while the additional working machine drive portion 16*b* is acting, the driver rod 92 is protruded via the actuator 93. Due to this operation, a forward end face 90*b* of the movable punch 90 can be protruded from the die face 38*a* by width H as shown in FIG. 3. At this time, the slider 32 is raised to the movable punch preparation position. Therefore, the movable punch 90 can be positively protruded. Since no load is given to the movable punch 90, the movable punch 90 can be protruded by a weak force. Therefore, it is sufficient to use an actuator 93, the capacity of which is small. For example, it is sufficient to use a pneumatic cylinder.

The driver rod 92 is set in such a manner that when the driver rod 92 is advanced at the maximum while the actuator 93 is acting, the forward end face 90*b* of the movable punch 90 is protruded from the die face 38*a* by width H. Alternatively, the driver rod 92 may be controlled as follows. When a linear sensor or a limit switch is provided and an advancing distance of the driver rod 92 is referred, the driver rod 92 is stopped when it is advanced at an appropriate position.

Figure 8:
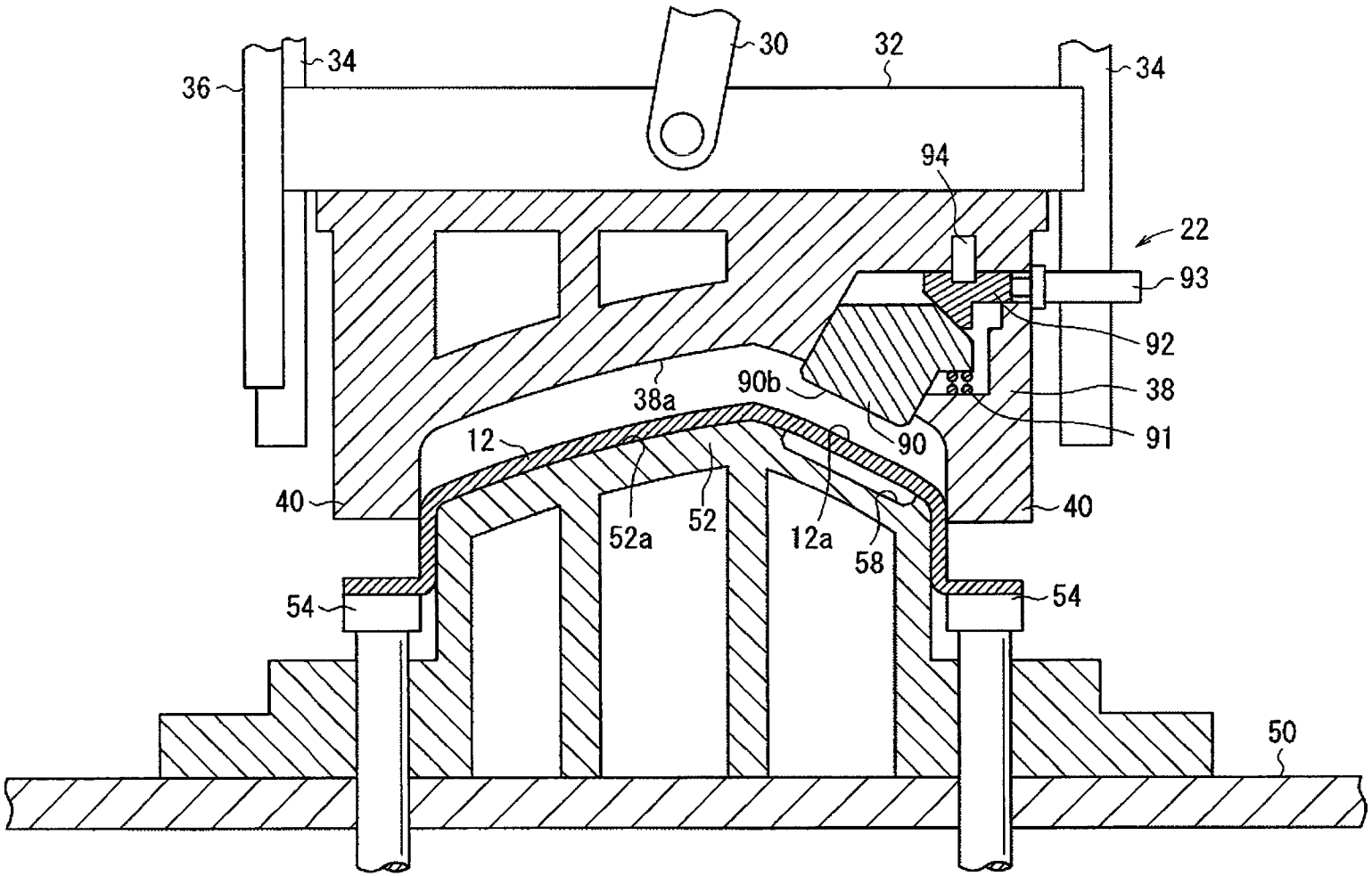
FIG. 8 is a partially sectional enlarged view showing an upper die, a lower die, an additional worked portion of a steel plate and an additional working portion in the case where a slider is raised to a movable punch preparation position and the movable punch is protruded and locked.

In step S10 (the punch protrusion step), as shown in FIG. 8, while the additional working machine drive portion 16*b* is acting, the mechanical lock 94 is driven so as to engage the mechanical lock 94 with the cutout portion 92*a* of the driver rod 92, and the driver rod 92 and the movable punch 90 are locked with each other. The mechanical lock 94 may be driven by a drive system of ON and OFF conducted by a solenoid. Alternatively, when a linear sensor or a limit switch is provided, an amount of advancement of the mechanical lock 94 may be controlled by the linear sensor or the limit switch.

In step S11 (the additional forming step) shown in FIG. 6, while the press drive portion 16*a* is acting, the servo motor 24 is driven and rotated so as to lower the slider 32 again.

In step S12 (the additional forming step), the press drive portion 16*a* confirms whether or not the slider 32 has reached the bottom dead center while referring to a signal sent from the first linear sensor 36. When the slider 32 has reached the bottom dead center, the program proceeds to step S13. When the slider 32 has not reached the bottom dead center, the slider 32 is continuously lowered.

Figure 9:
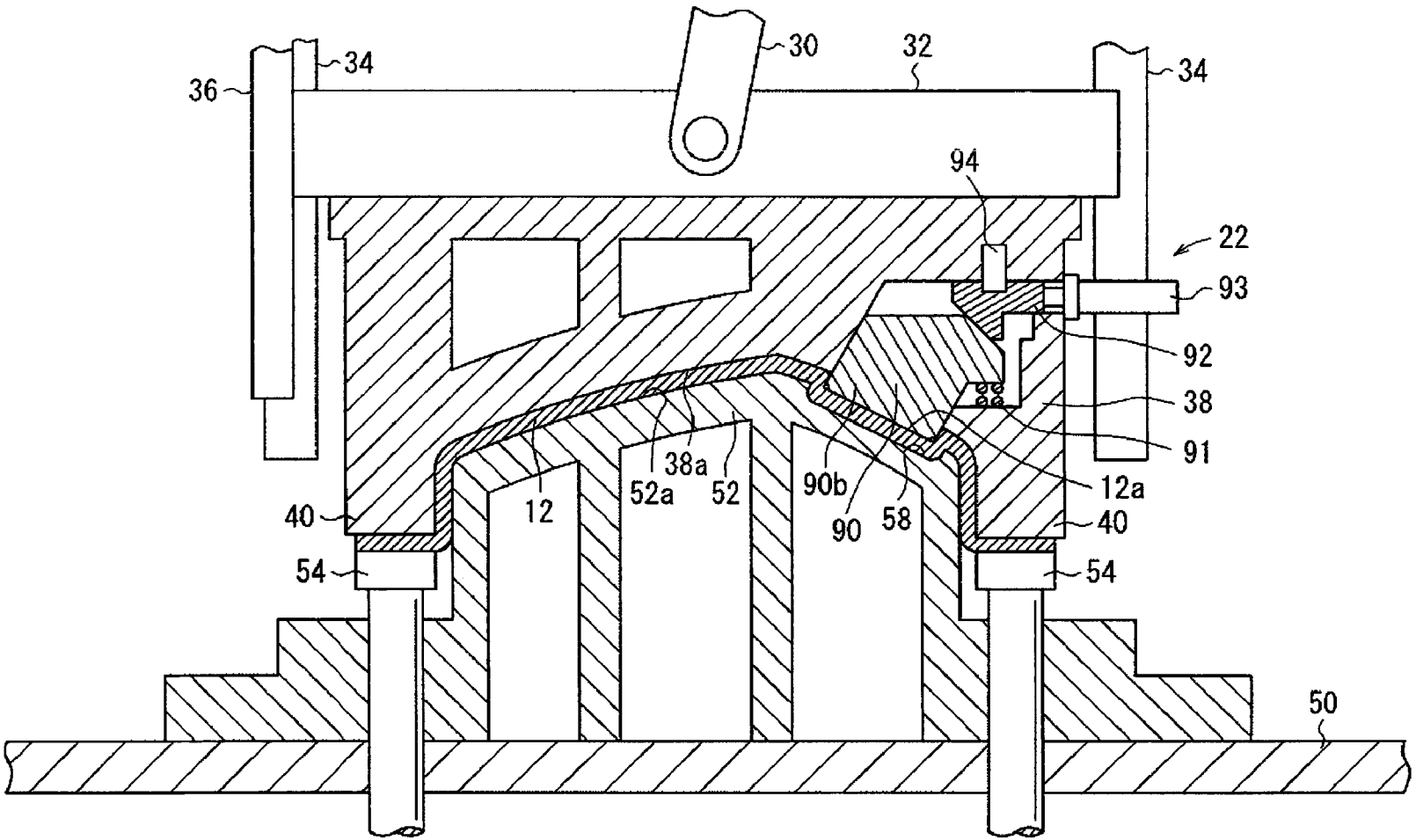
FIG. 9 is a partially sectional enlarged view showing a state in which a slider is lowered again to a bottom dead center from the state shown in FIG. 8.

In step S13 (the additional forming step), a descent of the slider 32 and a descent of the blank holder 54 are temporarily stopped. At this time, as shown in FIG. 9, the steel plate 12, which has already been press-formed, is pushed by the upper die 38 and the lower die 52. Further, when the movable punch 90 is inserted into the recess portion 58, the additional worked portion 12*a* is pushed and deformed. When the press working is conducted, the movable punch 90 receives a reaction force. However, since the movable punch 90 is fixed by the mechanical lock 94, press forming can be stably conducted.

Since the peripheral portion of the additional worked portion 12*a* is restricted by the die face 38*a* of the upper die 38 and the die face 52*a* of the lower die 52, wrinkles are not generated on the steel plate and press forming can be conducted with high accuracy. In the press working of the initial time conducted in step S4 and S5 and in the press working of the second time conducted in step S13, it is unnecessary to move the steel plate 12. Further, since the slider 32 is only reciprocated in the distance of displacement xp which is short enough, a working interval is short. Therefore, a cycle time can be reduced. Since the press working of the first time and the press working of the second time are continuously conducted in the same step, the working accuracy can be enhanced.

In step S14, while the additional working machine drive portion 16*b* is acting, the mechanical lock 94 is driven so as to draw it out from the cutout portion 92*a* of the driver rod 92, that is, the driver rod 92 and the movable punch 90 are unlocked.

Figure 10:
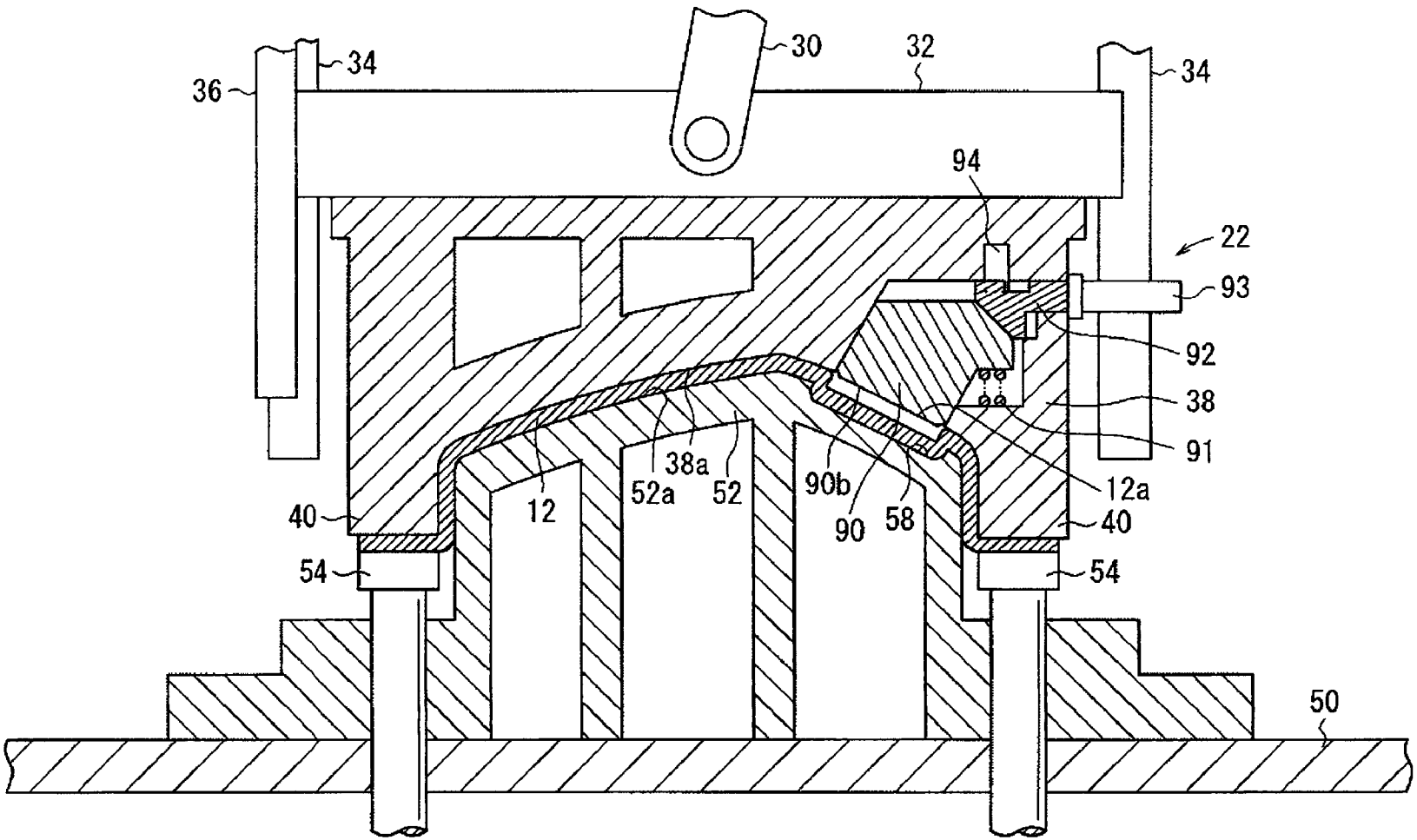
FIG. 10 is a partially sectional enlarged view showing a state in which a movable punch is retracted from the state shown in FIG. 9.

In step S15, as shown in FIG. 10, while the additional working machine drive portion 16*b* is acting, the drive rod 92 is retracted through the actuator 93 and moved until the protrusion 92*b* comes into contact with the step portion 95 of the upper die 38. Due to the above operation, while the spring 91 is exhibiting an elastic action, the movable punch 90 is retracted to a position where the front end face 90*b* of the movable punch 90 is located on the same face as the die face 38*a*.

In step S16, while the press drive portion 16*a* is acting, the servo motor 24 is driven and rotated to raise the slider 32. At the same time, while the die cushion drive portion 16*c* is acting, the blank holder 54 is raised. At this point of time, the blank holder 54 is left being stopped.

In step S17, it is confirmed whether or not the slider 32 has reached a panel conveyance position. When the slider 32 has reached the panel conveyance position, the program proceeds to step S18. When the slider 32 has not reached the panel conveyance position, the slider 32 continues to be raised.

In step S18, while the die cushion drive portion 16*c* is acting, the blank holder 54 is raised. Due to this operation, the blank holder 54 is raised a little later than the slider 32.

In step S19, the die cushion drive portion 16*c* confirms whether or not the blank holder 54 has reached the panel conveyance position. When the blank holder 54 has reached the panel conveyance position, the program proceeds to step S20. When the blank holder 54 has not reached the panel conveyance position, the blank holder 54 continues to be raised.

Figure 11:
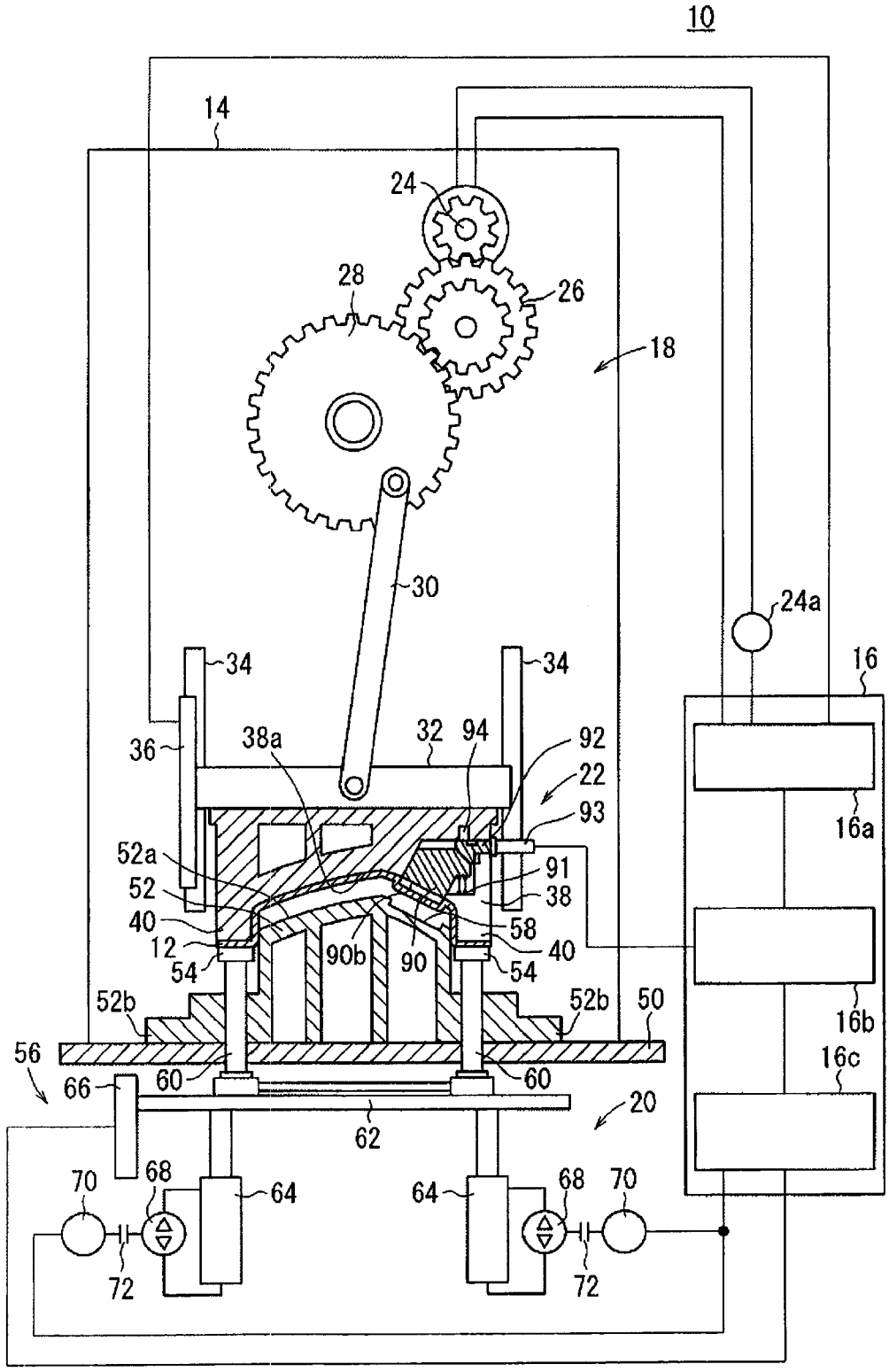
FIG. 11 is a schematic illustration showing an apparatus body in a state in which a rise in a blank holder is temporarily stopped at a panel conveyance position.

In step S20, as shown in FIG. 11, a rise of the blank holder 54 is temporarily stopped and the steel plate 12, which has already been subjected to press working and additional working, is conveyed to the next step, for example, a welding step by a predetermined conveyance means.

In step S21, the die cushion drive portion 16*c* raises the blank holder 54 again.

In step S22, the die cushion drive portion 16*c* confirms whether or not the blank holder 54 has reached a working wait position. When the blank holder 54 has reached the working wait position, the program proceeds to step S23. When the blank holder 54 has not reached the working wait position, the blank holder 54 continues to be raised.

In step S23, a rise of the blank holder 54 is stopped and the steel plate 12, which has not been worked yet, is arranged at a predetermined position. In this connection, even in this period of time, the slider 32 continues to be raised.

In step S24, the press drive portion 16*a* confirms whether or not the slider 32 has reached the top dead center referring to a signal sent from the first linear sensor 36. When the slider 32 has not reached the top dead center, it continues to be raised. When the slider 32 has reached the top dead center, the processing of this time shown in FIGS. 5 and 6 is completed. When the slider 32 has reached the top dead center, the slider 32 maybe temporarily stopped for maintaining an appropriate relation with the cycle time of the other step. In the case where no influence is given to the other step, the slider 32 may not be temporarily stopped and the next steel plate 12 may be continuously worked.

The above processing is expressed in one flow chart. However, for example, the press drive portion 16*a*, the additional working machine drive portion 16*b* and the die cushion drive portion 16*c* may be independently operated while the mutual synchronization is being confirmed among them.

Figure 12:
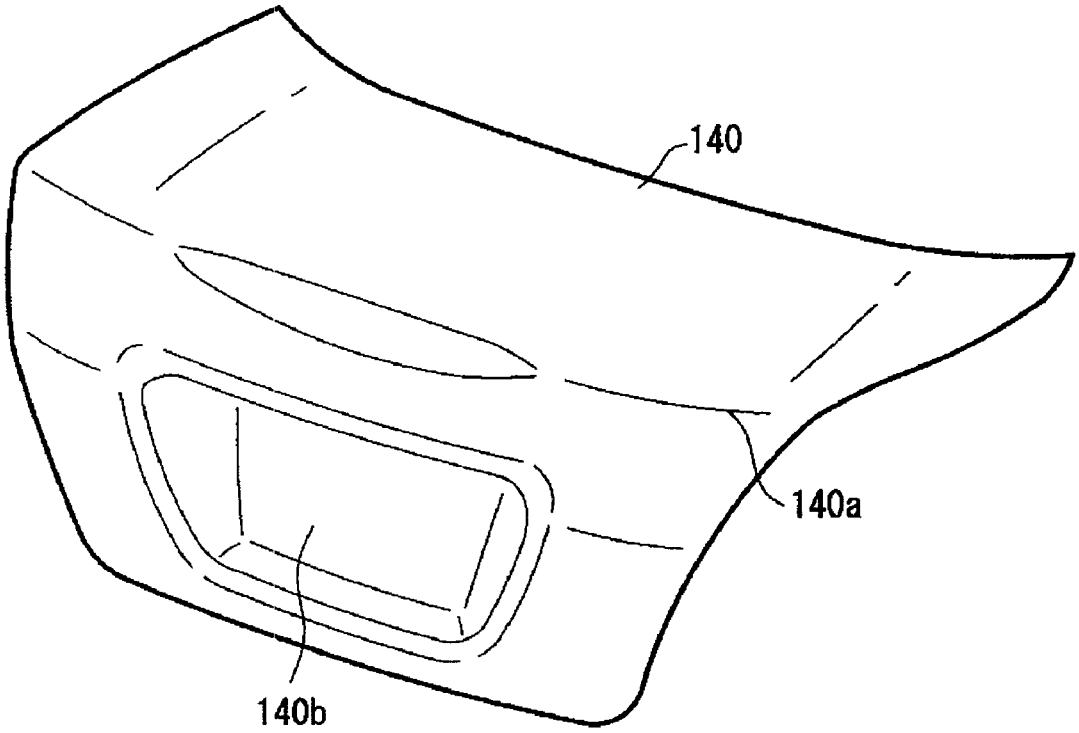
FIG. 12 is a perspective view showing a sheet metal member of a trunk portion of a vehicle.

According to the press working method and the press working apparatus 10 described above, for example, the trunk portion sheet metal 140 for a vehicle shown in FIG. 12 can be press-formed. In this case, the bent portion 140*a*, which is located on the boundary between the upper face and the rear face, is worked by the press forming of the first time. The dent portion 140*b*, to which a license plate is attached, is worked by the press forming of the second time. In this connection, the above dent portion 140*b* can not be formed by a conventional press working method and press working apparatus. Therefore, it is conventional that another part is attached at a position where the dent portion is to be formed. According to the press working method and the press working apparatus 10 of the first exemplary embodiment, it is possible to form the dent portion 140*b* out of one steel plate 12. Therefore, the number of parts and the number of man-days necessary for assembling can be reduced.

Figure 13A:
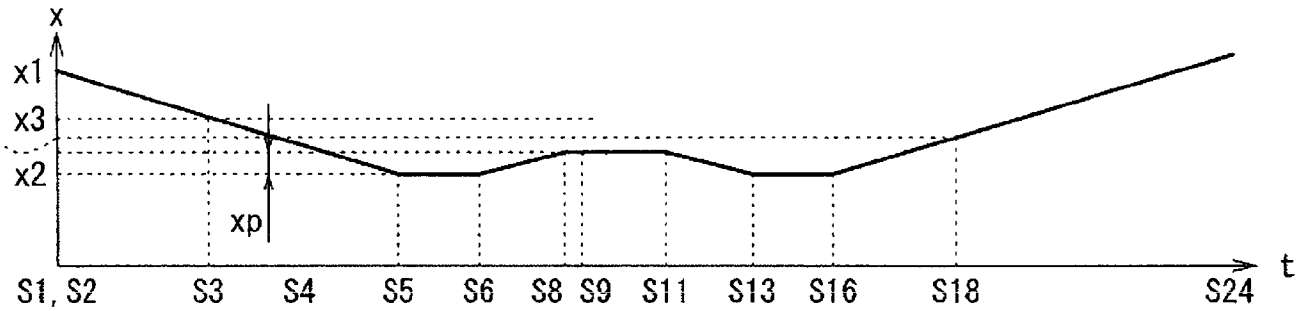
FIG. 13A is a graph showing a displacement of a slider in one cycle.
Figure 13B:
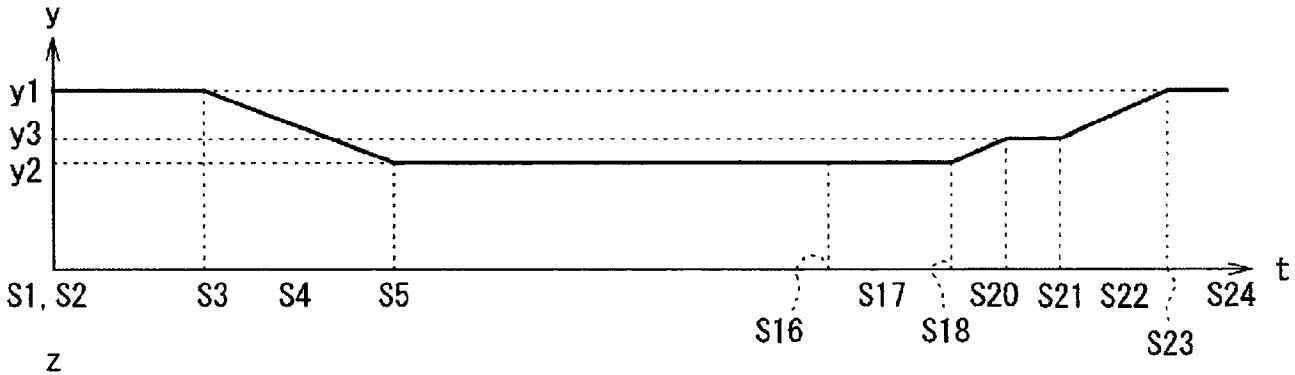
FIG. 13B is a graph showing a displacement of a blank holder in one cycle.
Figure 13C:
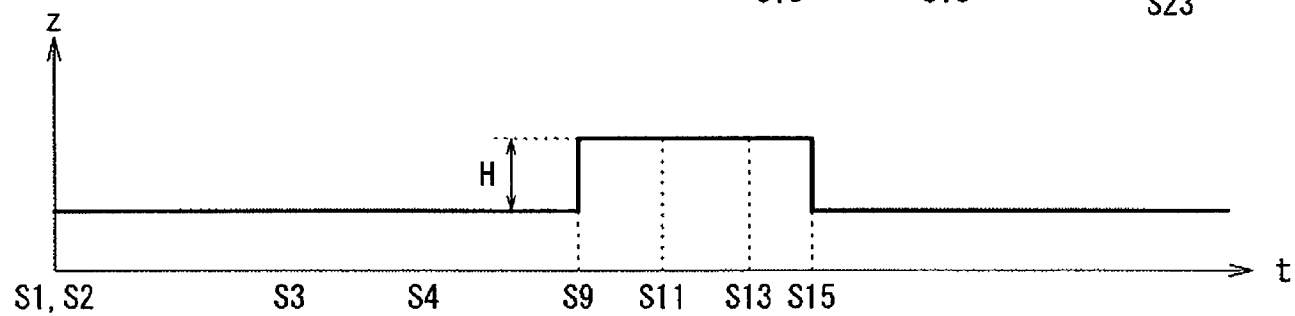
FIG. 13C is a graph showing a displacement of a movable punch in one cycle.

A series of the above working cycle is expressed by the time charts shown in FIGS. 13A to 13C. In the graphs of FIGS. 13A to 13C, on the axis of abscissas representing the time, the step numbers in the above processing are attached to corresponding portions.

As shown in FIG. 13A displacement x of the slider 32 changes as follows. Displacement x of the slider 32 changes from top dead center x1 to bottom dead center x2. Then, displacement x of the slider 32 once returns by displacement xp. After the processing of protruding and locking of the movable punch 90 (steps S9 and S10), displacement x of the slider 32 reaches bottom dead center x2 again. After the completion of step S18, displacement x of the slider 32 returns to top dead center x1 again. At the time corresponding to step S3, displacement x of the slider 32 reaches displacement x3 at which the holder 40 comes into contact with an upper face of the steel plate 12. Displacement x4 at the point of time of step S18 is a panel conveyance position, that is, displacement x4 at the point of time of step S18 is a position corresponding to displacement y3 of the blank holder 54.

As shown in FIG. 13B, displacement y of the blank holder 54 stops at working wait position y1 in the period of time corresponding to steps S1 to S3 and in the period of time after step S23. Between step S5 and step S18, displacement y of the blank holder 54 stops at the position of displacement y2. In the periods of time between step S3 and step S5, between step S18 and step S20 and between step S21 and step 23, the blank holder 54 ascends and descends at the substantially same speed as that of the slider 32. In the period of time between step S20 and step S21, the blank holder 54 stops at panel conveyance position y3.

As shown in FIG. 13C, displacement z of the movable punch 90 stops at wait position z1 in the periods of time between steps S1 and S9 and after step S15. The movable punch 90 starts protruding in step S9 right after step S8 and is displaced by width H. After that, the movable punch 90 returns to wait position z1 in step S15.

As described above, according to the press working method and the press working apparatus 10 of the first exemplary embodiment, after the completion of press forming of the first time, the upper die 38 is separated from the lower die 52 and the movable punch 90 is protruded and locked and then the upper die 38 is made to come close to the lower die 52 again. Due to the above operation, without using another independent working means, the steel plate 12, on which press forming of the first time has already been completed, can be subjected to press forming again.

Since the movable punch 90 is provided in the upper die 38, the entire press working apparatus can be made compact. Therefore, an installation space can be reduced. Further, only when the movable punch 90 is protruded from the upper die 38 and locked, a preparation of press forming of the second time is completed. Therefore, it is possible to effectively conduct press forming a plurality of times on the steel plate 12 in a short period of time of working. Further, since working can be conducted twice by one press working apparatus 10, no labor is required for conveying the steel plate 12 between the apparatus.

The time of conducting the step in which the movable punch 90 is protruded and the time of operating the additional working portion 22 are set by the control portion 16 which conducts controlling of making the upper die 38 come close to the lower die 52. Therefore, the movable punch 90 can be accurately synchronized with the press working.

Second Exemplary Embodiment

A press working method and a press working apparatus according to a second exemplary embodiment of the present invention will be explained, referring to FIGS. 14 to 20B. In the press working apparatus 210 of the second exemplary embodiment, press working of a steel plate 212, which is a workpiece, is conducted.

Figure 14:
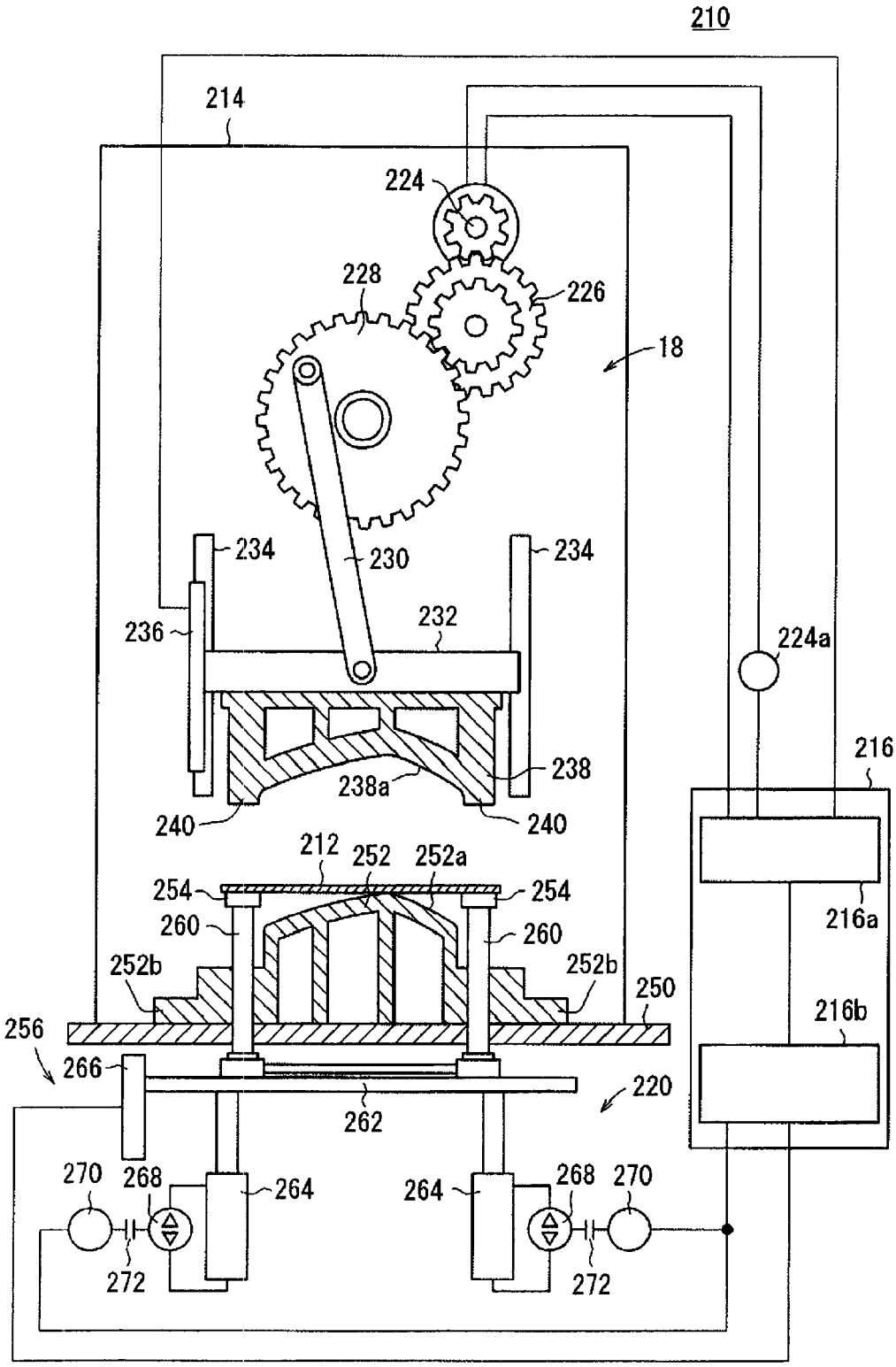
FIG. 14 is a schematic illustration showing an arrangement of the press working apparatus of a second exemplary embodiment.

As shown in FIG. 14, the press working apparatus 210 is provided with: an apparatus body 214 for conducting working; and a control portion 216 for controlling the apparatus body 214.

The apparatus body 214 is provided with: an upper die mechanism 218; and a lower die mechanism 220. The upper die mechanism 218 is provided with: a servo motor 224 which is a drive source; a reduction gear 226 driven and rotated by the servo motor 224; a rotary plate 228 driven and rotated by the reduction gear 226 at high torque; and a connecting rod 230, the upper end portion of which is pivotally attached onto a side of the rotary plate 228 so that the connecting rod 230 can be oscillated. The servo motor 224 is, for example, of the AC type. Therefore, the responding property of the servo motor 224 is high and torque generated by the servo motor 224 seldom deviates. A rotary position of the shaft of the servo motor 224 is detected by an encoder 224*a* and sent to the control portion 216.

The upper die mechanism 218 includes: a slider 232 pivotally supported by an end portion of the connecting rod 230; a plurality of rails 234 (for example, four rails 234) to guide the slider 232 in the vertical direction; a first linear sensor 236 to detect a position of the slider 232 and sent it to the control portion 216; and an upper die (a first die) 238 provided on a lower face of the slider 232.

The upper die 238 pinches a steel plate 212 together with a lower die (a second die) 252 so as to conduct press working. On a lower face of the upper die 238, a die face 238*a* is provided which comes into contact with an upper face of the steel plate 212. From the periphery of the upper die 238, an annular holder (a first holder) 240 is provided being a little protruded which is used for preventing the generation of wrinkles on the steel plate 212 and for preventing the occurrence of a positional deviation of the steel plate 212 at the time of press forming. Accordingly, the holder 240 comes into contact with the steel plate 212 before the die, face 238*a*. A lower face of the holder 240 is formed into a shape corresponding to the forming shape, for example, the lower face of the holder 240 is formed into a horizontal face The lower die mechanism 220 includes: a fixation table 250 which is used as a base; a lower die 252 arranged in an upper portion of the fixation table 250; an annular blank holder (a second holder) 254 for supporting a periphery of the steel plate 212; and a die cushion mechanism 256 for elevating a blank holder 254. The blank holder 254 is arranged being opposed to the holder 240. Therefore, the blank holder 254 pinches an end portion of the steel plate 212 together with the holder 240.

The lower die 252 is used for press working when it pinches the steel plate 212 together with the upper die 238. On an upper face of the lower die 252, a die face 252*a* is provided which comes into contact with a lower face of the steel plate 212. This die face 252*a* is formed into a shape corresponding to the aforementioned die face (the press forming face) 238*a*.

The die cushion mechanism 256 includes: a plurality of pins 260 which penetrate the fixation table 250 and the attaching portion 252*b* of the lower die 252 from the lower side and are fixed in a lower portion of the blank holder 254; a plate 262 for connecting lower end portions of these pins 260; a plurality of cylinders 264 for elevating the plate 262; and a second linear sensor 266 for detecting a position of the plate 262 and sending a signal of the position of the plate 262 to the control portion 216.

The die cushion mechanism 256 includes: a hydraulic motor 268 for supplying hydraulic fluid to the cylinders 264 and for recovering hydraulic fluid from the cylinders 264; and a servo motor 270 for rotating the hydraulic motor 268. Rotation of the servo motor 270 is transmitted to the hydraulic motor 268 through a transmission portion 272 including a coupling, a reduction gear and so forth. The hydraulic motor 268 is rotated either normally or reversely being driven by the servo motor 270. Therefore, it is possible for the hydraulic motor 268 to selectively supply hydraulic fluid to the rod side or the cap side of the cylinder 264. Due to the above constitution, while predetermined pressure control is being conducted, the periphery of the steel plate 212 is appropriately pushed by both the holder 240 and the blank holder 254. Therefore, the generation of wrinkles can be prevented.

The control portion 216 includes: a press drive portion 216*a* for driving and controlling the servo motor 224 while referring to signals sent from the encoder 224*a* and the first linear sensor 236; and a die cushion drive portion 216*b* for elevating the blank holder 254 by driving the servo motor 270 while referring to a signal sent from the second linear sensor 266. The press drive portion 216*a* and the die cushion drive portion 216*b* are connected with each other. Therefore, the press drive portion 216*a* and the die cushion drive portion 216*b* can be operated synchronously with each other. While the die cushion drive portion 216*b* is being synchronized with the press drive portion 216*a*, the die cushion drive portion 216*b* can change an elevating speed of the blank holder 254 at predetermined time.

Figure 15:
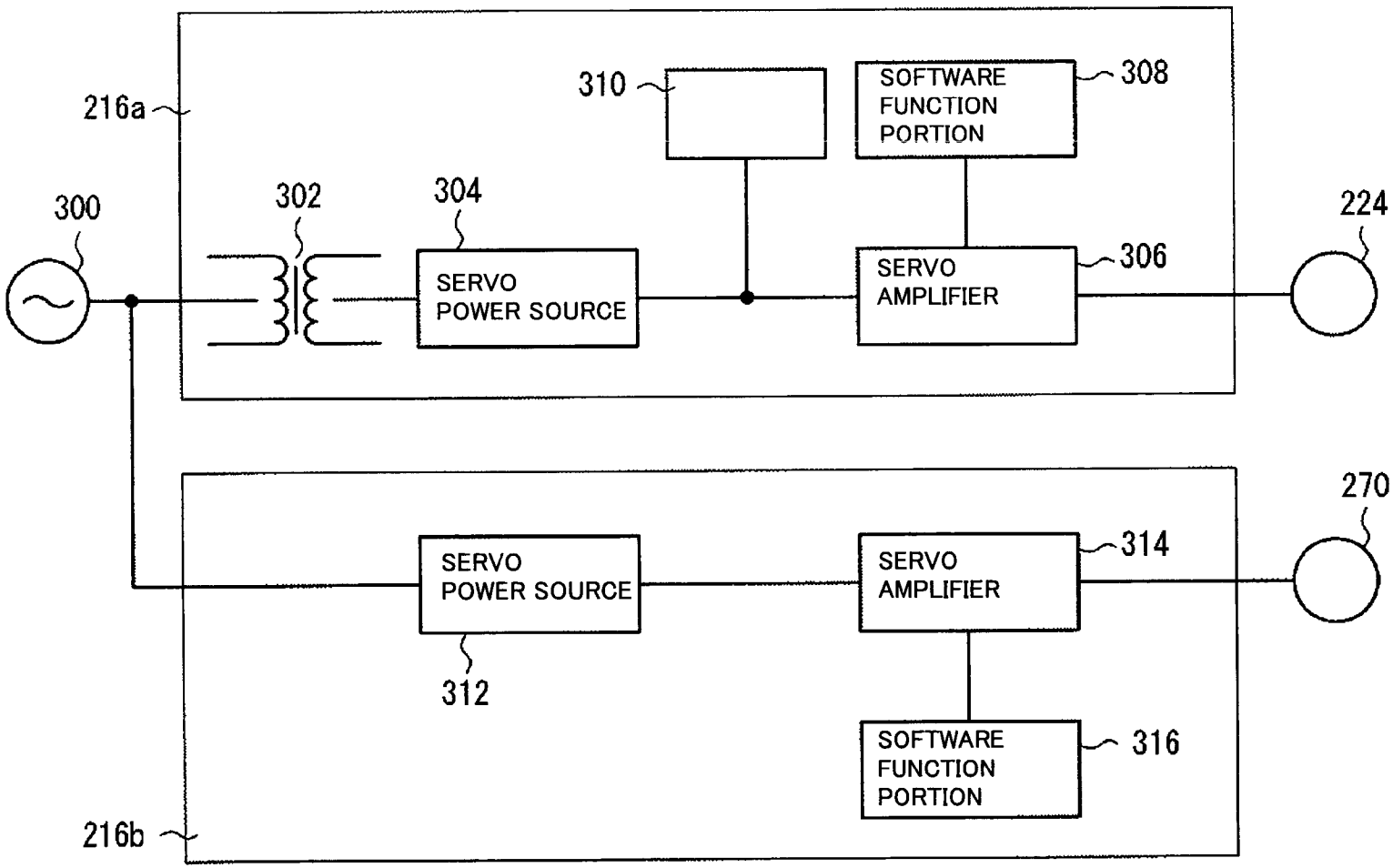
FIG. 15 is a block arrangement diagram showing a press drive portion and a die cushion drive portion.

As shown in FIG. 15, the press drive portion 216*a* includes: a servo power source portion 304 to which electric power obtained from an electric power source 300 is supplied after the voltage has been raised by a transformer 302; and a servo amplifier 306 for driving the servo motor 224 with electric power adjusted by the servo power source portion 304. In the servo amplifier 306, an amount of driving of the servo amplifier 306 is set while the software functional portion 308 is acting. A large capacity condenser 310 is provided between the servo power source portion 304 and the servo amplifier 306.

The die cushion drive portion 216*b* includes: a servo power source portion 312 to which electric power is supplied from the power source 300; and a servo amplifier 314 for driving the servo motor 270 with electric power adjusted by the servo power source portion 312. An amount of driving of the servo motor 270 is set by the servo amplifier 314 while the software functional portion 316 is acting.

An electric current can be made to flow in both the positive and the negative direction in the servo power source portion 312 and the servo amplifier 314. In the case where the servo motor 270 is rotated by a load and generates electricity, it is possible to conduct a regeneration of electric power in which an electric current obtained by the generation of electric power is supplied to the press drive portion 216*a*. The thus regenerated electric power is stored in the large capacity condenser 310 and used for driving the servo motor 224. Therefore, an increase in the power source capacity can be suppressed.

Figure 16:
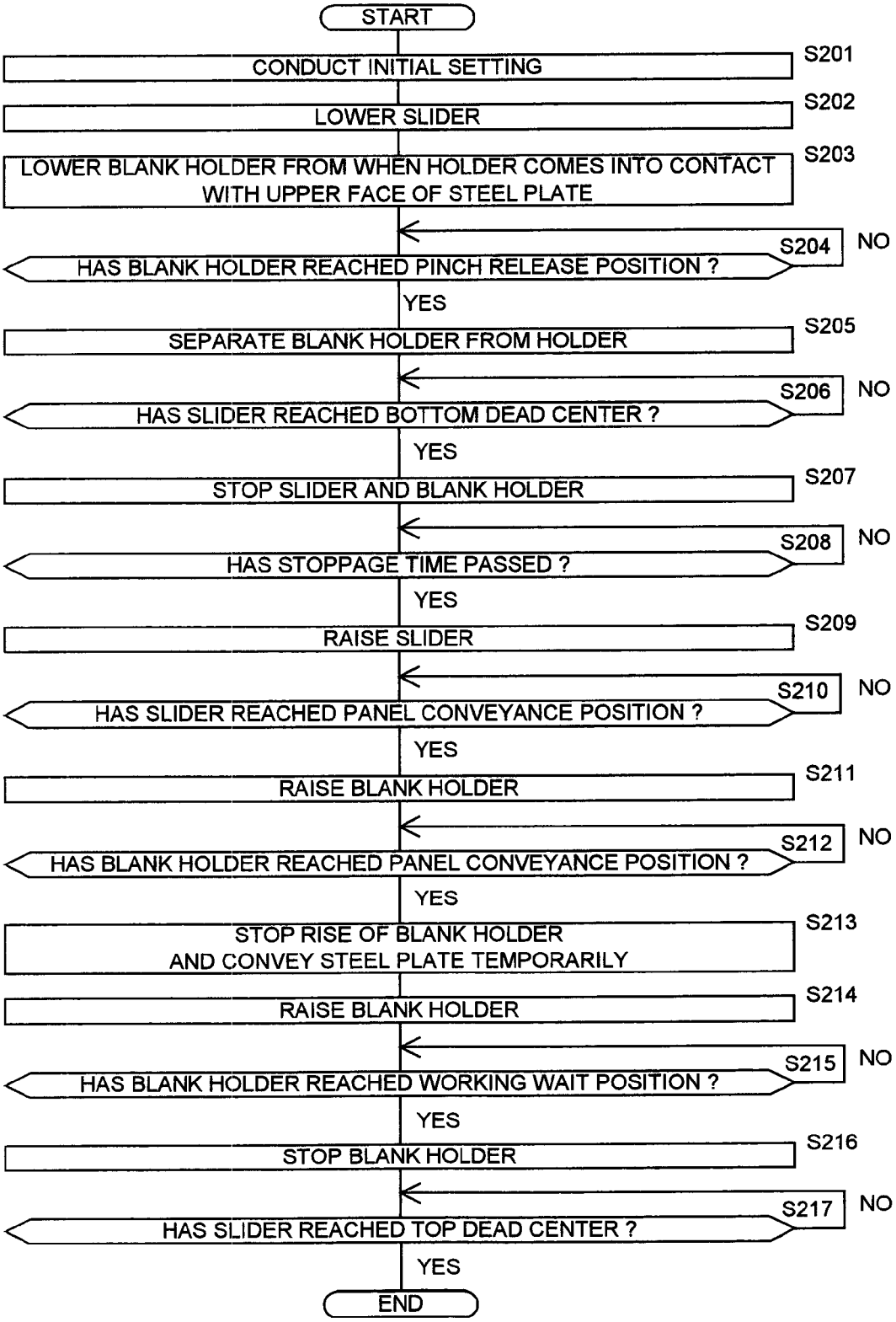
FIG. 16 is a flow chart showing a procedure of the press working method of the second exemplary embodiment.

Referring to FIG. 16, explanations will be made into a working method of working the steel plate 212, which is a workpiece, with the press working apparatus 210 composed as described above.

First of all, initial setting is made in step S201 in FIG. 16. That is, after the blank holder 254 has been raised to a predetermined position, the steel plate 212, which has not been worked yet, is supported by the blank holder 254. The upper die 238 is raised to an upper dead center.

In step S202, while the press drive portion 216*a* is acting, the servo motor 224 is driven and rotated so as to lower the slider 232.

When the slider 232 is somewhat lowered, the holder 240 comes into contact with an upper face of the steel plate 212. Therefore, the steel plate 212 is interposed between the holder 240 and the blank holder 254. At this point of time (shown by displacement x3 in FIG. 20A), the blank holder 254 is lowered while the die cushion drive portion 216*b* is acting (step S203). The die cushion drive portion 216*b* conducts pressure control so that the blank holder 254 can be lowered while the steel plate 212 is positively being held by an appropriate force generated by the blank holder 254 when a lower face of the steel plate 212 is pushed by the blank holder 254. That is, the blank holder 254 is pushed by the holder 240 via the steel plate 212. Therefore, the blank holder 254 is lowered while the steel plate 212 is being given an appropriate force.

Due to the foregoing, while the peripheral portion of the steel plate 212 is being held by the holder 240 and the blank holder 254, the steel plate 212 is gradually pressed to a product shape by the upper die 238 and the lower die 252.

In the case of lowering the blank holder 254, the aforementioned regeneration may be made when electric power is generated by the servo motor 270.

In step S204, according to a signal sent from the first linear sensor 236, the press drive portion 216*a* confirms whether or not positions of the holder 240 and the blank holder 254 have reached a predetermined pinch release position. When the positions of the holder 240 and the blank holder 254 have reached the predetermined pinch release position, the program proceeds to step S205. When the positions of the holder 240 and the blank holder 254 have not reached the predetermined pinch release position, the descent is continued. This pinch release position is previously set at an appropriate position according to the press shape. Mostly, this pinch release position is set at a position a little higher than the bottom dead center, which is the lowest point in one stroke of the upper die 238, at which the steel plate 212 is pressed by the die faces 238*a* and 252*a*. The pinch release position is adjusted according to a deformation made by the press working. In the case where the plastic flow is small and press forming is conducted only by bending, distance xp (shown in FIG. 20B) from the bottom dead center to the pinch release position is set at a very low value. In the case where the plastic flow is large and press forming is conducted by deep drawing, distance xp is set at a high value.

In the case where the product shape is a gentle shape in which press lines are seldom recognized, the pinch release position may agree with the bottom dead center, that is, xp=0. In other words, the pinch release position may be set at a position after the point of time of starting to press the steel plate 212 (Refer to displacement x3 of FIG. 20A.) and before the arrival at the bottom dead point.

Figure 17:
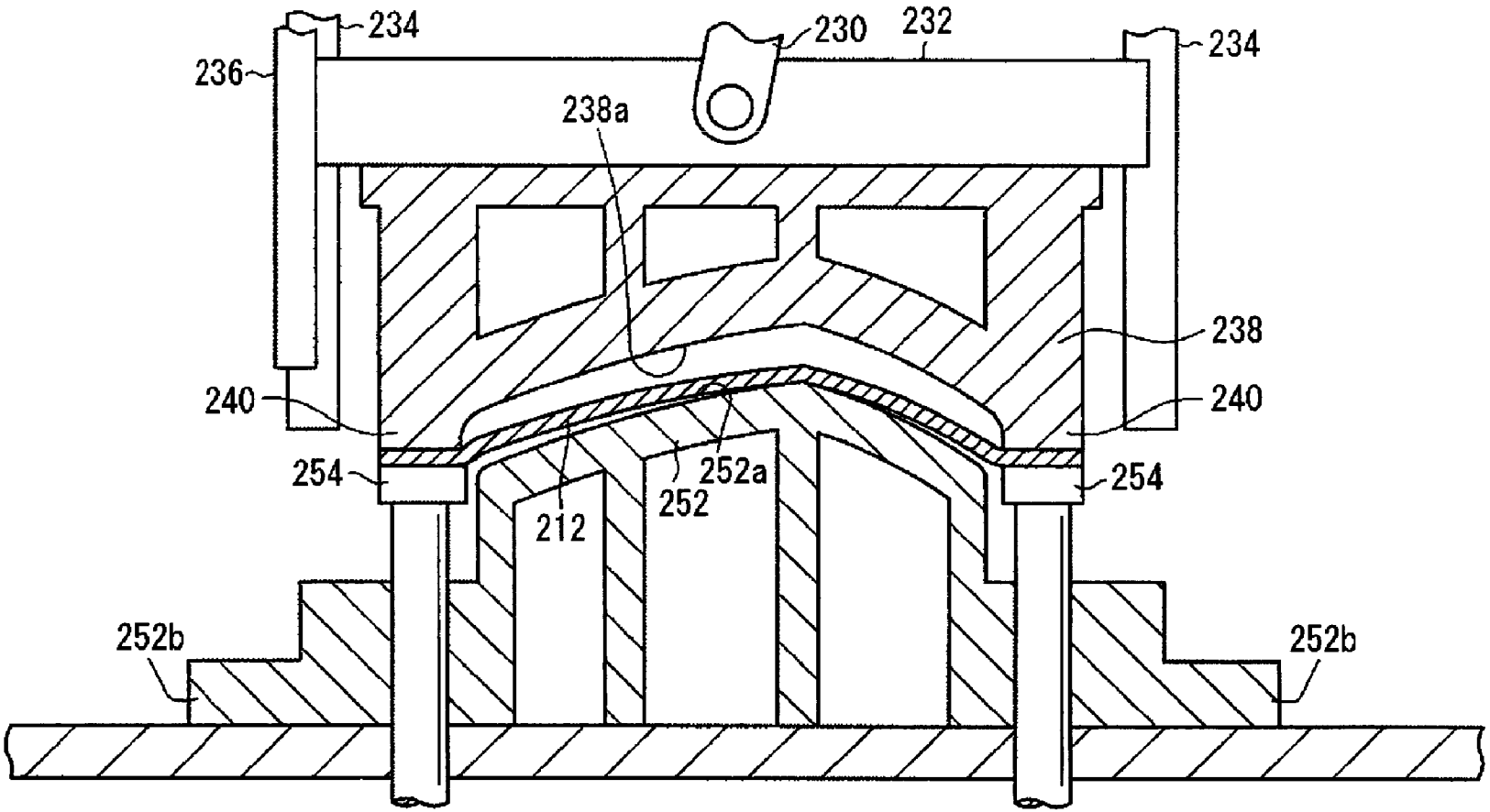
FIG. 17 is a partially sectional view showing an upper die, lower die, holder and blank holder at the time of an arrival of a blank holder at a pinch release position.

As shown in FIG. 17, at this pinch release position, press forming of the steel plate 212 has already been started by the upper die 238 and the lower die 252. However, since the upper die 238 and the lower die 252 have not reached the bottom dead point yet, press forming has not been completed yet.

In step S205, while the die cushion drive portion 216*b* is acting, a lowering speed of the blank holder 254 is increased higher than a lowering speed of the holder 240, so that the blank holder 254 can be separated from the holder 240 and the steel plate 212. Due to the foregoing, a hold of the steel plate 212 is released and the steel plate 212 can be freely moved. Accordingly, a portion of the held steel plate 212 is made to plastically flow. Since press working is substantially finished at this point of time, a product shape of the steel plate 212 is mostly formed. Therefore, even when a reference of positioning, which is determined by holding, is not provided, there is no possibility that the shape of the product is collapsed.

At this point of time, it is unnecessary that the blank holder 254 gives a pushing force to the steel plate 212. Therefore, the blank holder 254 may be separated from the holder 240 by a small distance. Alternatively, as shown by the virtual line in FIG. 18, a portion of the steel plate 212 may be contacted with the blank holder 254. Further, a force given by the pressure in the cylinder 264 may be sufficiently reduced by a predetermined decompressing mechanism.

In step S219, the press drive portion 216*a* confirms whether or not the slider 232 has reached the bottom dead center referring to a signal sent from the first linear sensor 236. When the slider 232 has reached the bottom dead center, the program proceeds to step S207. When the slider 232 has not reached the bottom dead center, it continues to descend.

Figure 18:
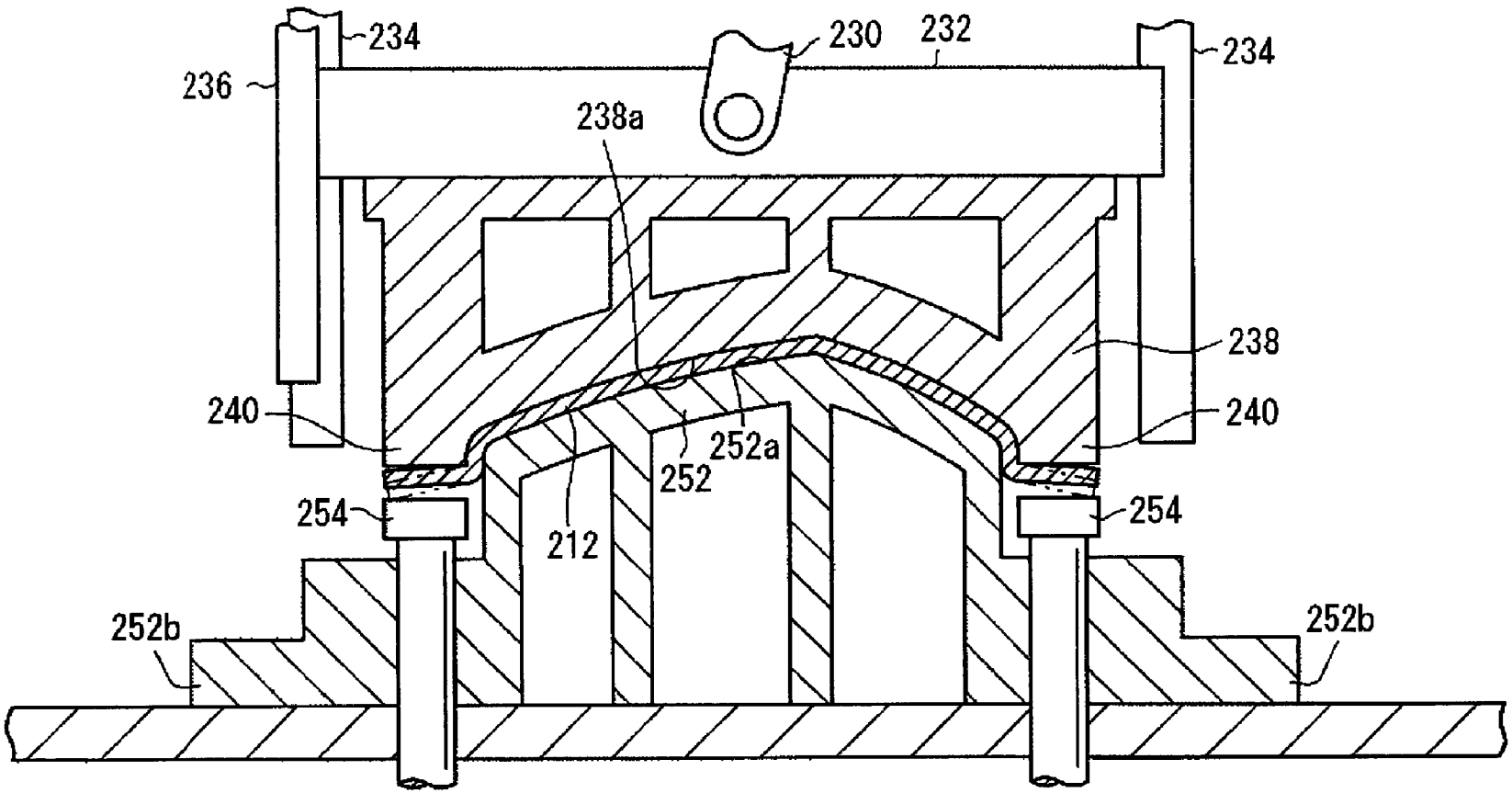
FIG. 18 is a partially sectional view showing an upper die, lower die, holder and blank holder at the time of an arrival of a slider at a bottom dead center.

As shown in step S207, the descent of the slider 232 and the descent of the blank holder 254 are stopped. At this time, as shown in FIG. 18, the steel plate 212 is pinched between the die face 238*a* of the upper die 238 and the die face 252*a* of the lower die 252 and press working has already been finished. Since the blank holder 254 is separated from the holder 240, the steel plate 212 is released from pinching. On the other hand, in press working, when both the dies are made to come most close to each other at the bottom dead center, a reduction of the wall thickness becomes the maximum in the process of press working. Therefore, since the steel plate 212 is released from being pinched at this point of time, it is possible to effectively prevent the generation of wrinkles and small wall thickness portions which are caused when the steel plate 212 is excessively strongly stretched.

In step S208, it is confirmed whether or not a predetermined period of time of stoppage has passed. When the predetermined period of time of stoppage has passed, the program proceeds to step S209. When the slider 232 is stopped for the predetermined period of time at the bottom dead center, it becomes possible to give strain in the wall thickness direction. Therefore, a product shape of the steel plate 212 can be further stabilized.

In step S209, while the press drive portion 216*a* is acting, the servo motor 224 is driven and rotated so as to raise the slider 232. At this point of time, the blank holder 254 is left being stopped.

In step S210, it is confirmed whether or not the slider 232 has reached the panel conveyance position. When the slider 232 has reached the panel conveyance position, the program proceeds to step S211. When the slider 232 has not reached the panel conveyance position, the descent of the slider 232 is continued.

In step S211, while the die cushion drive portion 216*b* is acting, the blank holder 254 is raised. Due to the foregoing, the blank holder 254 is raised a little later than the slider 232 and contacted with an end portion of the steel plate 212 again so that the steel plate can be raised.

In step S212, the die cushion drive portion 216*b* confirms whether or not the blank holder 254 has reached the panel conveyance position. When the blank holder 254 has reached the panel conveyance position, the program proceeds to step S213. When the blank holder 254 has not reached the panel conveyance position, the blank holder 254 continues to be raised.

Figure 19:
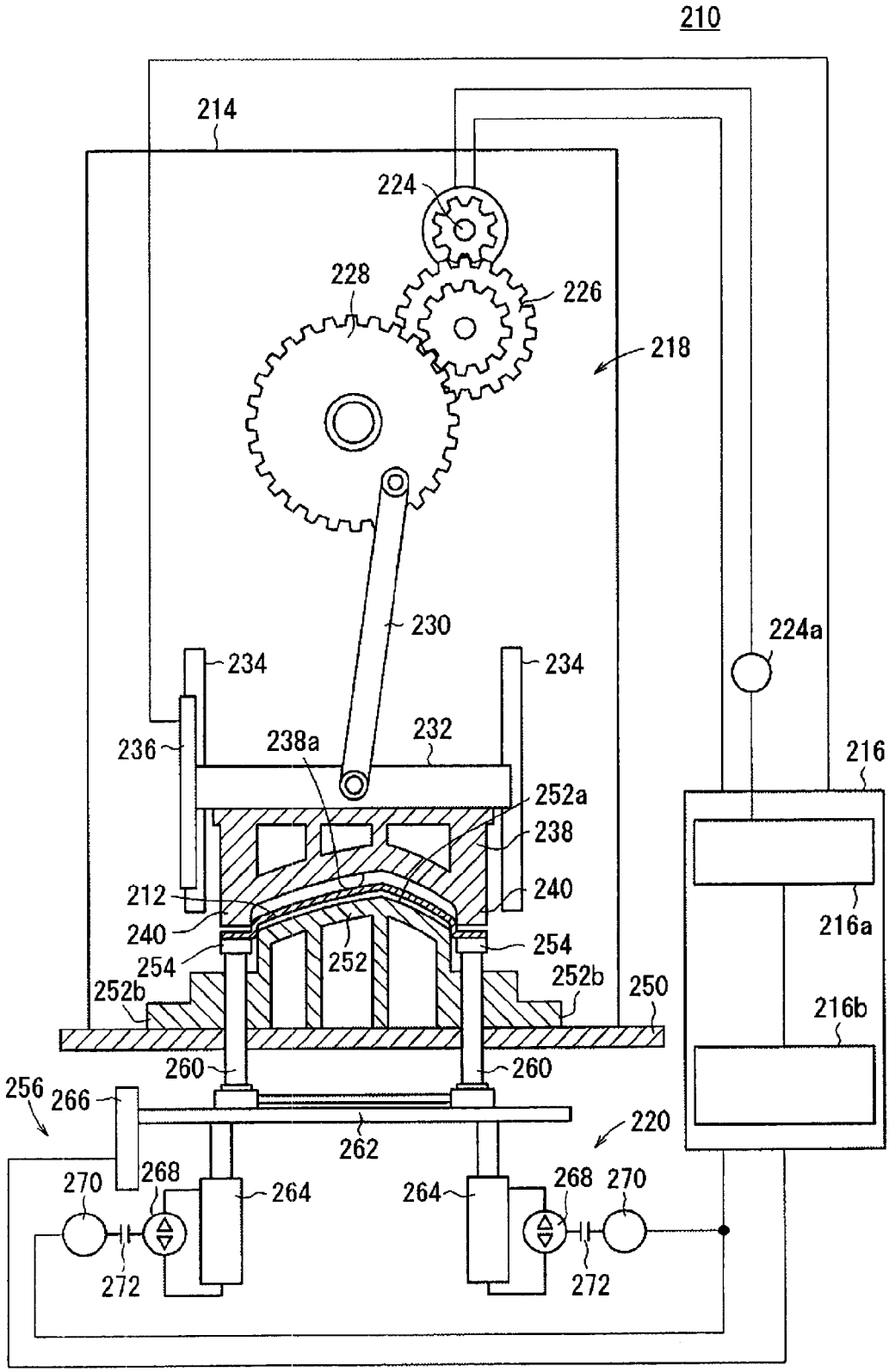
FIG. 19 is a schematic illustration of a press forming apparatus in a state in which a rise of a blank holder is temporarily stopped at a panel conveyance position.

In step S213, as shown in FIG. 19, a rise of the blank holder 254 is temporarily stopped. Then, the steel plate 212, which has already been pressed, is conveyed to the next step, for example, a welding step, by a predetermined conveyance means.

In step S214, the die cushion drive portion 216*b* raises the blank holder 254 again.

In step S215, the die cushion drive portion 216*b* confirms whether or not the blank holder 254 has reached a working wait position. When the blank holder 254 has reached the working wait position, the program proceeds to step S216. When the blank holder 254 has not reached the working wait position, the blank holder 254 continues to be raised.

In step S216, a rise in the blank holder 254 is stopped and the steel plate 212, which has not been worked yet, is arranged at a predetermined position. In this connection, even in this period of time, the slider 232 continues to be raised.

In step S217, the press drive portion 216*a* confirms whether or not the slider 232 has reached the top dead center referring to a signal sent from the first linear sensor 236. When the slider 232 has not: reached the top dead center, it continues to be raised. When the slider 232 has reached the top dead center, the processing of this time shown in FIG. 16 is completed. When the slider 232 has reached the top dead center, the slider 232 may be temporarily stopped for maintaining an appropriate relation with the cycle time of the other step. In the case where no influence is given to the other step, the slider 232 may not be temporarily stopped and the next steel plate 212 may be continuously worked.

The above processing is expressed in one flow chart. However, for example, the press drive portion 216*a* and the die cushion drive portion 216*b* may be independently operated while the mutual synchronization is being confirmed between them.

Figure 20A:
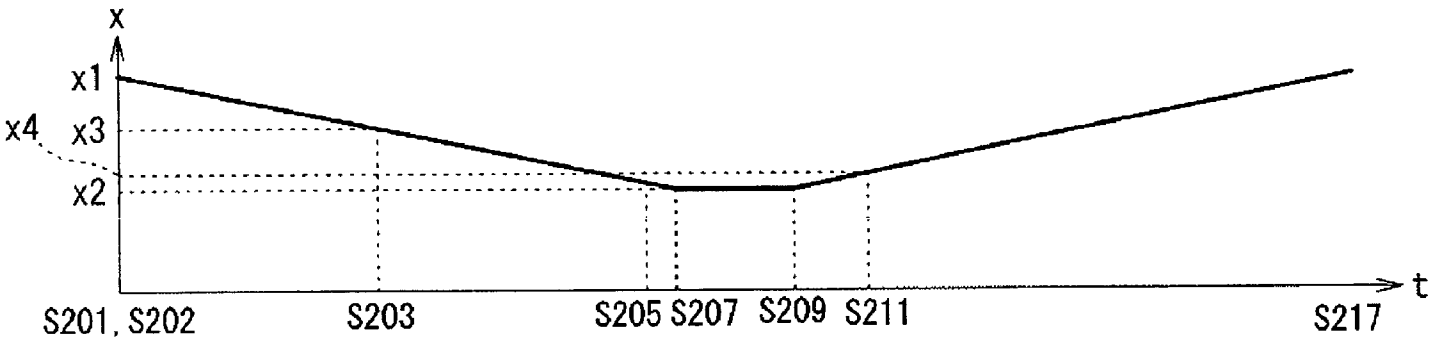
FIG. 20A is a graph showing a displacement of a slider in one cycle and FIG. 20B is a graph showing a displacement of a blank holder in one cycle.
Figure 20B:
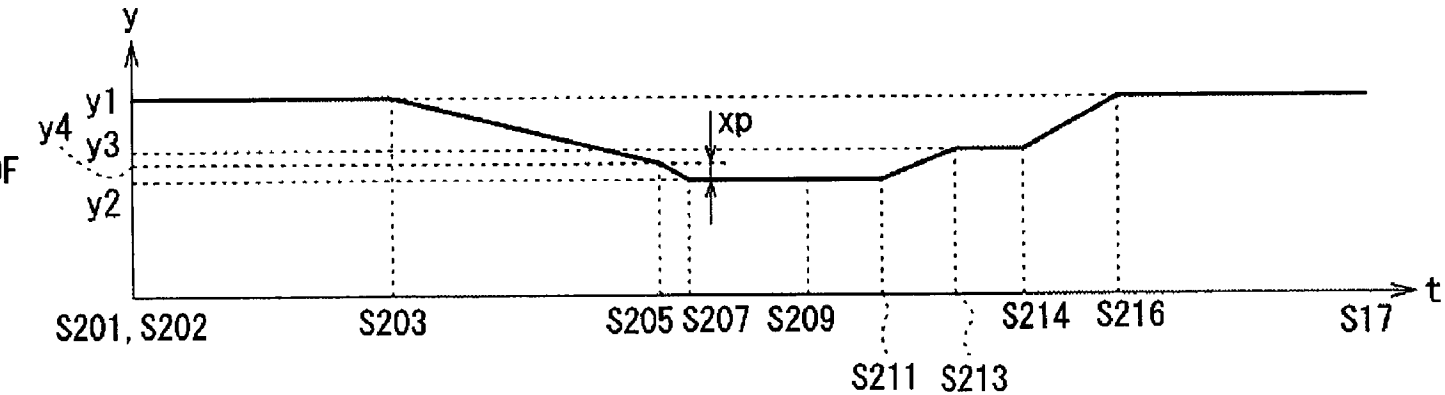

A series of the above working cycle is expressed by the time charts shown in FIGS. 20A and 20B. In the graphs of FIGS. 20A and 20B, on the axis of abscissas representing the time, the step numbers in the above processing are attached to corresponding portions.

As shown in FIG. 20A, displacement x of the slider 232 reciprocates between top dead center x1 and bottom dead center x2. At bottom dead center x2, the slider 232 stops for a predetermined period of time (a period of time between step S205 and S208). At the time corresponding to step S203, the holder 240 reaches displacement x3 at which the holder 240 comes into contact with an upper face of the steel plate 212. Displacement x4 at the point of time of step S211 is the panel conveyance position, that is, displacement x4 at the point of time of step S211 is the position corresponding to displacement y3 of the blank holder 254.

As shown in FIG. 20B, displacement y of the blank holder 254 stops at working wait position yl in the period of time corresponding to steps S201 to S203 and in the period of time after step S215. Between step S207 and step S211 in which the slider 232 stops at bottom dead center x2, the blank holder 254 is also stopped at the position of displacement y2. Between steps S203 and S204, the blank holder 254 is lowered at the substantially same speed as that of the slider 232. Between steps S204 and S205 after the blank holder 254 has exceeded pinch release position y4, the blank holder 254 is lowered at a speed a little higher than that of the slider 232. In the period of time between steps S213 and S214, the blank holder 254 stops at panel conveyance position y3.

As described above, according to the press working method and the press working apparatus 210 of the second exemplary embodiment, before the arrival at the bottom dead center at which both the dies are made to come close to each other, a pinch of the steel plate 212 conducted by the holder 240 and the blank holder 254 is released. Therefore, the steel plate 212 can be moved and it becomes possible to prevent the generation of wrinkles and small wall thickness portions which are caused when the steel plate 212 is excessively stretched.

At least when press working is started, the steel plate 212 is positively pinched by the holder 240 and the blank holder 254. Therefore, the steel plate 212 is accurately positioned and it is possible to prevent wrinkles from being generated in the process of working.

Further, it is basically unnecessary to slide the steel plate 212 in the pinch portion in which the steel plate 212 is pinched between the holder 240 and the blank holder 254. Therefore, it is unnecessary to finely adjust a pushing force given to the steel plate 212. Pinching and releasing of the steel plate 212 can be sufficiently controlled by ON-OFF control in which a lowering speed of the blank holder 254 is changed over. In the pinch portion in which the steel plate 212 is pinched by the holder 240 and the blank holder 254, it is unnecessary to coat lubricant on the steel plate 212. Accordingly, the press working method and the press working apparatus 210 of the second exemplary embodiment can be suitably applied to press working except for deep drawing. Therefore, the press working method and the press working apparatus 210 of the second exemplary embodiment can be suitably applied to mass production.

In the case of working workpieces, the shapes and sizes of which are approximate to each other, the greater the grade of a plastic flow and drawing, the greater the grade in which a press-worked portion of the steel plate 212 is stretched by a pinch portion in which the steel plate 212 is pinched by the holder 240 and the blank holder 254. Therefore, distance xp from the bottom dead center to the pinch release position maybe set according to the grade of the plastic flow and drawing.

The control portion 216 conducts controlling of making the upper die 238 come close to the lower die 252 and also conducts controlling of releasing a pinch of the steel plate, wherein controlling of making the upper die 238 come close to the lower die 252 and controlling of releasing a pinch of the steel plate are synthetically combined with each other. Therefore, press working can be accurately synchronized with releasing of a pinch of the steel plate.

In this connection, in the embodiment explained above, when a lowering speed of the blank holder 254 is increased at the pinch release position, a pinch of the steel plate 212 is released. However, when the holder 240 is separated from the die face 238*a* by a predetermined mechanism so as to reduce the lowering speed, the pinch may be released.

It should be noted that the press working method and the press working apparatus of the present invention are not limited to the above specific embodiments but variations may be made without departing from the spirit and scope of claim of the present invention.

What is claimed is:

1. A press working method of working a press-formed product with a servo press, comprising:

a press forming step in which a plate is pressed between a first die and a second die while the plate is also being pinched between a first and a second holder, said first holder being integrally provided by said first die and being movable with said first die; and a pinch release step of releasing the plate from between the first and the second holders after press forming of the plate was started in the press forming step by integrally moving the first holder and the first die toward the second die while moving the second holder away from the first holder, the pinch release step occurring before both the first and second dies reach a bottom dead center position in which the first and second dies are a minimum distance from one another.

2. The press working method according to claim 1, wherein a control operation time in the pinch release step is set by a controller for controlling the first die so that the first die can be made to come close to the second die.

3. A press working method, comprising the steps of:

providing a movable first die, said first die integrally providing a first holder;

providing a stationary second die that is aligned with said first die and that cooperates with said first die to work a plate;

providing a second holder that is associated with, but movable relative to, the stationary second die, said second holder being aligned with said first holder;

placing the plate on the second holder;

moving the first die toward the second die such that a peripheral portion of the plate is pinched between the first holder and the second holder;

further moving the first die toward the second die such that, while the peripheral portion of the plate remains pinched between the first holder and the second holder, an interior portion of the plate is pressed between and worked by the first die and the second die;

monitoring a position of the first die relative to a predetermined pinch release position; and upon reaching said predetermined pinch release position, moving the second holder in a direction away from the first holder faster than said first die moves toward said second die and thereby releasing said peripheral portion of the plate from the first and second holders.

4. The press working method of claim 3, wherein the pinch release position occurs before the first and second dies are a minimum distance from one another.

* * * * *